US007201658B2

(12) United States Patent
Marshall et al.

(10) Patent No.: US 7,201,658 B2
(45) **Date of Patent: *Apr. 10, 2007**

(54) INTERACTIVE WAGERING SYSTEM

(75) Inventors: Connie T. Marshall, Muskogee, OK (US); Kevin D. Satterfield, Tulsa, OK (US); Jon C. Zaring, Glenpool, OK (US); Joni L. Hamilton, Haskel, OK (US); Joseph C. Jacobson, Broken Arrow, OK (US)

(73) Assignee: ODS Properties, Inc., Los Angeles, CA (US)

( * ) Notice: Subject to any disclaimer, the term of this patent is extended or adjusted under 35 U.S.C. 154(b) by 239 days.

This patent is subject to a terminal disclaimer.

(21) Appl. No.: 10/881,349

(22) Filed: Jun. 30, 2004

(65) Prior Publication Data

US 2004/0235561 A1 Nov. 25, 2004

Related U.S. Application Data

(63) Continuation of application No. 09/616,478, filed on Jul. 14, 2000, now Pat. No. 6,773,347.

(60) Provisional application No. 60/193,893, filed on Mar. 31, 2000.

(51) Int. Cl.
*A63F 9/24* (2006.01)

(52) U.S. Cl. ..... 463/25; 463/40; 379/93.13; 715/700; 715/716

(58) Field of Classification Search ..... 463/12–13, 463/16–20, 25–26, 29, 40–43; 273/292–293, 273/143 R; 379/93.12–93, 93.09; 340/323 R, 340/825.29, 5.1, 5.4; 700/91–93; 705/14, 705/16–18; 902/23; 377/4–5
See application file for complete search history.

(56) References Cited

U.S. PATENT DOCUMENTS

| | | | |
|---|---|---|---|
| 3,909,002 | A | 9/1975 | Levy |
| 4,033,588 | A | 7/1977 | Watts |
| 4,108,361 | A | 8/1978 | Krause |

(Continued)

FOREIGN PATENT DOCUMENTS

| | | |
|---|---|---|
| EP | 0 387 046 | 9/1990 |
| EP | 0 583 196 | 2/1994 |
| EP | 0 620 688 | 10/1994 |

(Continued)

OTHER PUBLICATIONS

Burgess, John, "And We're Off To The Races!" The Washington Post, Jan. 16, 1995, pp. 17-18.

(Continued)

*Primary Examiner*—Mark Sager
(74) *Attorney, Agent, or Firm*—Fish & Neave IP Group of Ropes & Gray LLP

(57) ABSTRACT

An interactive wagering application is provided that displays information areas on various wager creation screens. The information areas may be configurable. Information such as promotions, weather information, jockey information, trainer information, odds, or any other suitable information may be displayed in the information areas. The interactive wagering application may create a wagering ticket that reflects the amount of a user's wager and the total amount of the user's wager when multiple runners are taken into account. The interactive wagering application may record the user's position within the application and the user's recent wagering selections, so that this information may be used to assist the user in restarting the application after exiting or when creating additional wagers.

40 Claims, 15 Drawing Sheets

U.S. PATENT DOCUMENTS 4,322,612 A 3/1982 Lange
4,339,798 A 7/1982 Hedges et al.
4,372,558 A 2/1983 Shimamoto et al.
4,494,197 A 1/1985 Troy et al.
4,593,904 A 6/1986 Graves
4,636,951 A 1/1987 Harlick
4,652,998 A 3/1987 Koza et al.
4,689,742 A 8/1987 Troy et al.
4,694,490 A 9/1987 Harvey et al.
4,704,725 A 11/1987 Harvey et al.
4,706,121 A 11/1987 Young
4,745,468 A 5/1988 Von Kohorn
4,747,600 A 5/1988 Richardson
4,760,527 A 7/1988 Sidley
4,764,666 A 8/1988 Bergeron
4,799,683 A 1/1989 Bruner, Jr.
4,815,741 A 3/1989 Small
4,882,473 A 11/1989 Bergeron et al.
4,922,522 A 5/1990 Scanlon
4,926,255 A 5/1990 Von Kohorn
4,926,327 A 5/1990 Sidley
4,965,825 A 10/1990 Harvey et al.
4,969,183 A 11/1990 Reese
4,996,705 A 2/1991 Entenmann et al.
5,007,649 A 4/1991 Richardson
5,034,807 A 7/1991 Von Kohorn
5,054,787 A 10/1991 Richardson
5,057,915 A 10/1991 Von Kohorn
5,083,271 A 1/1992 Thacher et al.
5,083,272 A 1/1992 Walker et al.
5,083,800 A 1/1992 Lockton
5,096,195 A 3/1992 Gimmon
5,096,202 A 3/1992 Hesland
5,112,050 A 5/1992 Koza et al.
5,119,295 A 6/1992 Kapur
5,178,389 A 1/1993 Bentley et al.
5,186,471 A 2/1993 Vancraeynest
5,218,631 A 6/1993 Katz
5,227,874 A 7/1993 Von Kohorn
5,233,654 A 8/1993 Harvey et al.
5,249,044 A 9/1993 Von Kohorn
5,276,312 A 1/1994 McCarthy
5,280,426 A 1/1994 Edmonds
5,282,620 A 2/1994 Keesee
5,283,734 A 2/1994 Von Kohorn
5,286,023 A 2/1994 Wood
5,297,802 A 3/1994 Pocock et al.
5,326,104 A 7/1994 Pease et al.
5,327,485 A 7/1994 Leaden
5,333,868 A 8/1994 Goldfarb
5,340,119 A 8/1994 Goldfarb
5,351,970 A 10/1994 Fioretti
5,354,069 A 10/1994 Guttman et al.
5,365,575 A 11/1994 Katz
5,398,932 A 3/1995 Eberhardt et al.
5,403,999 A 4/1995 Entenmann et al.
5,408,417 A 4/1995 Wilder
5,411,258 A 5/1995 Wilson et al.
5,415,416 A 5/1995 Scagnelli et al.
5,417,424 A 5/1995 Snowden et al.
5,428,791 A 6/1995 Andrew et al.
5,505,449 A 4/1996 Eberhardt et al.
5,507,489 A 4/1996 Reibel et al.
5,518,253 A 5/1996 Pocock et al.
5,539,450 A 7/1996 Handelman
5,539,822 A 7/1996 Lett
5,545,088 A 8/1996 Kravitz et al.
5,564,977 A 10/1996 Algie
5,569,083 A 10/1996 Fioretti
5,573,244 A 11/1996 Mindes
5,575,474 A 11/1996 Rossides
5,577,727 A 11/1996 Brame et al.
5,586,937 A 12/1996 Menashe
5,608,785 A 3/1997 Kasday
5,643,088 A 7/1997 Vaughn et al.
5,647,795 A 7/1997 Stanton
5,679,077 A 10/1997 Pocock et al.
5,683,090 A 11/1997 Zeile et al.
5,688,174 A 11/1997 Kennedy
5,713,795 A 2/1998 Kohorn
5,722,890 A 3/1998 Libby et al.
5,729,212 A 3/1998 Martin
5,746,657 A 5/1998 Ueno
5,749,785 A 5/1998 Rossides
5,755,621 A 5/1998 Marks et al.
5,759,101 A 6/1998 Von Kohorn
5,762,552 A 6/1998 Vuong et al.
5,772,511 A 6/1998 Smeltzer
5,787,156 A 7/1998 Katz
5,800,268 A 9/1998 Molnick
5,801,703 A 9/1998 Bowden et al.
5,816,917 A 10/1998 Kelmer et al.
5,816,919 A 10/1998 Scagnelli et al.
5,823,879 A 10/1998 Goldberg et al.
5,830,067 A 11/1998 Graves et al.
5,830,068 A 11/1998 Brenner et al.
5,830,069 A 11/1998 Soltesz et al.
5,871,398 A 2/1999 Schneier et al.
5,910,047 A 6/1999 Scagnelli et al.
5,954,582 A 9/1999 Zach
5,999,808 A 12/1999 LaDue
6,001,016 A 12/1999 Walker et al.
6,007,426 A 12/1999 Kelly et al.
6,024,640 A 2/2000 Walker et al.
6,024,641 A 2/2000 Sarno
6,030,288 A 2/2000 Davis et al.
6,080,062 A 6/2000 Olson
6,080,063 A 6/2000 Khosla
6,099,408 A 8/2000 Schneier et al.
6,102,797 A 8/2000 Kail
6,110,041 A 8/2000 Walker et al.
6,117,011 A 9/2000 Lvov
6,117,013 A 9/2000 Eiba
6,152,824 A 11/2000 Rothschild et al.
6,186,892 B1 2/2001 Frank et al.
6,203,427 B1 3/2001 Walker et al.
6,251,016 B1 6/2001 Tsuda et al.
6,251,017 B1 6/2001 Leason et al.
6,254,480 B1 7/2001 Zach
6,257,982 B1 7/2001 Rider et al.
6,264,560 B1 7/2001 Goldberg et al.
6,266,060 B1 7/2001 Roth
6,272,223 B1 8/2001 Carlson
6,273,820 B1 8/2001 Haste, III
6,674,448 B1 1/2004 Garahi et al.
6,712,701 B1 3/2004 Boylan, III et al.
6,735,487 B1 5/2004 Marshall et al.
6,773,347 B1 * 8/2004 Marshall et al. ..... 463/25
6,837,789 B2 1/2005 Garahi et al.
6,837,791 B1 1/2005 Ramsey et al.
2001/0003099 A1 6/2001 Von Kohorn
2001/0003100 A1 6/2001 Yacenda
2001/0031656 A1 10/2001 Marshall et al.
2001/0037211 A1 11/2001 McNutt et al.
2001/0037293 A1 11/2001 Hindman et al.
2001/0047291 A1 11/2001 Garahi et al.
2001/0051540 A1 12/2001 Hindman et al.

FOREIGN PATENT DOCUMENTS

EP 0 624 039 11/1994
EP 0 673 004 9/1995
EP 0 873 772 10/1998
EP 0 934 765 8/1999

| | | |
|---|---|---|
| GB | 2 229 565 | 9/1990 |
| GB | 2 300 535 | 11/1996 |
| JP | 01-25659 | 1/1989 |
| JP | 01-269157 | 10/1989 |
| JP | 02-110660 | 4/1990 |
| JP | 02-231671 | 9/1990 |
| JP | 06-325062 | 11/1994 |
| WO | WO 95/01058 | 1/1995 |
| WO | WO 95/30944 | 11/1995 |
| WO | WO 97/19428 | 5/1997 |
| WO | WO 00/77752 | 12/2000 |
| WO | WO 01/03088 | 1/2001 |
| WO | WO 01/41025 | 6/2001 |
| WO | WO 01/65508 | 9/2001 |
| WO | WO 01/65509 | 9/2001 |
| WO | WO 01/73649 | 10/2001 |

OTHER PUBLICATIONS

Chang, Yee-Hsiang, et al., "An Open-Systems Approach To Video On Demand," IEEE Communications Magazine, May 1994, pp. 68-80.

Daily Racing Form, "Guide to the Expanded Past Performances," 1993, p. 21.

Driving directions (from mapquest.com), showing initial mapquest system launched Feb. 1996, 6 pages.

Peddicord, Ross, "New On TV: You Bet Your Horse," The Sun, Baltimore, Maryland, Dec. 15, 1994.

Probe XL Brochure, AutoTote Systems, Inc., Newark, Delaware (undated).

Report No. DOT/FAA/CT-96/1, "Human Factors Design Guide," by Dan Wagner, dated Jan. 15, 1996, 8 pages plus pp. 8-40 through 8-45.

Tiny Tim Brochure, AutoTote Systems, Inc., Newark, Delaware (undated).

TrackMaster User's Guide Version 2.0.7, Apr. 1994, AXCIS Pocket Information Network, Inc., Santa Clara, California, pp. 1-122.

Wolff, Maury, "Interactive Wagering A Good Bet," Daily Racing Form, Jan. 29, 1995, p. 4.

You Bet Help File, Youbet.com, Inc., Los Angeles, California, last modified Jul. 11, 1998, pp. 1-132.

US 5,823,877, 10/1998, Scagnelli et al. (withdrawn)

* cited by examiner

INTERACTIVE WAGERING SYSTEM

CROSS REFERENCE TO RELATED APPLICATIONS

This application is a continuation of U.S. patent application Ser. No. 09/616,478, filed Jul. 14, 2000, now U.S. Pat. No. 6,773,347, which claims the benefit of U.S. provisional application No. 60/193,893, filed Mar. 31, 2000.

BACKGROUND OF THE INVENTION

This invention relates to interactive wagering, and more particularly, to interactive wagering applications with configurable on-screen information areas and enhanced wager creation features.

Wagering is a popular leisure activity. For example, many racing fans wager on events such as horse, dog, and harness racing. However, it may be inconvenient to attend racing events in person. Not all racing fans have sufficient time to visit racetracks as often as they would like and some fans have difficulties in obtaining suitable transportation to the track. Off-track betting establishments are available for fans who cannot attend racing events in person, but fans must still travel to the off-track betting establishments.

As a result, systems have been developed in which fans may place off-track wagers using personal computers connected to the Internet, standard telephones, or set-top boxes.

It is an object of the present invention to improve such systems by providing an interactive wagering system with configurable on-screen information areas and enhanced wager creation features.

SUMMARY OF THE INVENTION

An interactive wagering system is provided. An interactive wagering application is implemented using the system.

The interactive wagering application may provide wager creation screens for the user to use in creating wagers. The wager creation screens may have information areas. The information areas may be associated with menu items or options on the wager creation screens. For example, on a racetrack selection menu screen an information area may be associated with each available racetrack. On a race selection screen, there may be an information area associated with each available race option. Other screens such as wager type selection screens, wager amount selection screens, and horse selection screens, may also be provided with information areas.

Personnel associated with racetracks or other content creators may create and modify the content for the information areas. For example, the content creators may change the content in an information area using a web page interface or any other suitable system. The web page interface may allow the content creators to type text into a data entry field that corresponds to the information area on the wager creation screen. Material may also be dragged and dropped into the data entry field. A preview function may be provided that allows the content creator to preview the content of the screens including the content of the information areas.

If desired, personnel associated with the interactive wagering application may ensure that the content supplied by the content creator is satisfactory, before the content is provided to users. Content may also be created by personnel associated with the interactive wagering application.

Changes to the content of the information areas may be made without any need to recompile the code for the interactive wagering application.

Various different types of content may be displayed in the information areas. For example, information on the current weather at a particular racetrack may be displayed in an information area adjacent to the listing for that racetrack on a track selection screen. Promotional information may also be included in an information area. For example, a special offer that is available at a particular track may be displayed in an information area associated with that track on a track selection menu. Information areas may also be used to display information on upcoming events, track hours, directions, etc. If a track is closed due to rain, information announcing the track closure may be displayed in an information region adjacent to the track name. On a horse selection menu, the information region adjacent to each selectable horse option may be used for odds, jockey information, trainer information, etc. An information region may be used when listing a betting interest that includes two horses. Information for the first horse (e.g., 1*a*) may be placed in the horse name area. Information for the second horse (e.g., horse 1*b*) may be placed into the information area adjacent to the information region containing the first horse name.

If desired, the content of the information areas may be periodically rotated. For example, new content may be displayed in the information regions every second or every few seconds.

If desired, the information areas may be made interactive. For example, when a user has highlighted a desired information area, the user may press a remote control "info" key to obtain additional information related to the content of the highlighted information area.

If multiple horses are associated with a single horse number (e.g., three horses 2*a*, 2*b*, and 2*c* are associated with slot No. 2), the notation "multiple runners" may be placed in the horse name field. The associated information area may be used to display a message such as "press info for details." If the user highlights the multiple runners field and presses info, the additional information on each of the multiple runners may be provided.

Sometimes a user may desire to exit the interactive wagering application in the midst of creating a wager. The interactive wagering application may automatically record the user's position within the interactive wagering application. When the user subsequently restarts the interactive wagering application, the interactive wagering application may allow the user to automatically resume the wager creation process where the user left off. Moreover, the user's most frequently chosen wager criteria or the user's last wager may be used to assist the user when creating a wager. When the user is creating a wager, the interactive wagering application may assume that the wagering criteria (e.g., the selected track, race, wager type, horses, and wager amount) that were last used or were most frequently used reflect the user's preferences. Accordingly, these wagering criteria may be used as defaults when the interactive wagering application is populating fields in the wager creation screens. As an example, if the user's last wager was made at the track Churchill Downs, the next time that the interactive wagering application presents the track selection menu to the user, the track Churchill Downs may be preselected in the track selection menu. The user therefore need not search for the Churchill Downs entry when selecting the track for the wager.

A wagering ticket may be provided on the wager creation screens. As the wager is built, the entries in the wagering ticket may be updated. For example, after the user has selected a racetrack, the racetrack may be added to the wagering ticket. If a wager is created with multiple runners (e.g., an exacta wager), information is provided for each runner.

If the user creates a second wager by adding an additional runner to one portion of the wager (e.g., by selecting a second horse for a win wager or the like), the wagering ticket may be used to display information on both the selected wager amount (e.g., $2) and the total amount of the wager (e.g., $4).

In the horse selection menu when creating a wager, horse numbers may be provided in color. Moreover, the color of each horse's number in the horse selection menu may be matched to the official saddle blanket colors used in racing. For example, the graphic image of the number one for horse number one may be red, because that is the standard blanket color for runner number 1. The graphic image of the number two for horse number two may be white, because white is the standard blanket color for runner number 2, etc.

Further features of the invention, its nature and various advantages will be more apparent from the accompanying drawings and the following detailed description of the preferred embodiments.

DETAILED DESCRIPTION OF THE PREFERRED EMBODIMENTS

Figure 1:
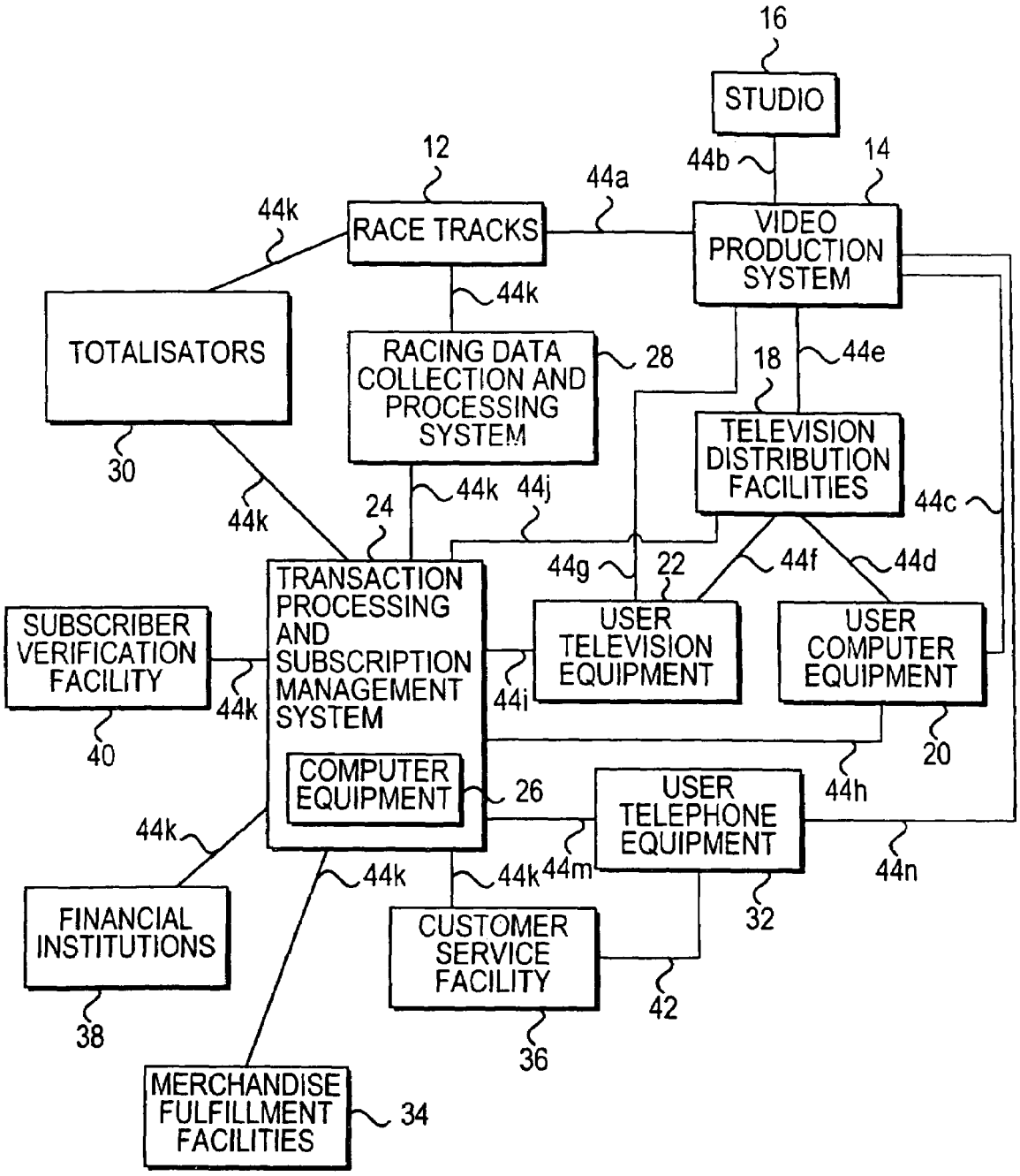
FIG. 1 is a schematic diagram of an illustrative interactive wagering system on which an interactive wagering application may be implemented in accordance with the present invention.

An illustrative interactive wagering system 10 in accordance with the present invention is shown in FIG. 1. Aspects of the invention apply to various different types of wagering, but are described herein primarily in the context of interactive wagering on races (e.g., horse races) for specificity and clarity.

Races may be run at racetracks 12, which may be located at various geographic locations. Races run at the racetracks may be simulcast to television viewers. For example, simulcast videos may be provided to users with satellite receivers or to off-track betting establishments via satellite.

System 10 may be used to provide an interactive wagering service to users of various user equipment. An interactive wagering application may be used to provide the wagering service. The interactive wagering application may run locally on the user equipment (e.g., on a set-top box, personal computer, cellular telephone, handheld computing device, etc.) or may run using a client-server or distributed architecture where some of the application is implemented locally on the user equipment in the form of a client process and some of the application is implemented at a remote location (e.g., on a server computer or other such equipment in the system) as a server process. These arrangements are merely illustrative. Other suitable techniques for implementing the interactive wagering application may be used if desired.

Real-time videos from racetracks 12 may also be provided to video production system 14 for distribution to users as part of a television wagering service (i.e., a wagering-related television channel or Internet-delivered service or the like). If desired, multiple simulcast videos may be provided to video production system 14 in real-time. Talent (e.g., commentators) for the television wagering service provided by the interactive wagering application may be located at studio 16. Studio 16 may provide a video feed containing commentary and the like to video production system 14. Graphic overlays for the television wagering service may be added to the service at video production system 14.

The television wagering service may use video production system 14 to combine selected video segments from desired racing simulcasts with the video feed from studio 16 and suitable graphic overlays. If desired, video production system 14 or a separate facility may be used to reformat simulcasts from racetracks 12. For example, if racetracks 12 provide simulcasts as traditional analog television channels, video production system 14 (or a separate facility) may convert these simulcasts or portions of these simulcasts into digital signals (e.g., digital video signals) or into a different number of analog signals. Digital video signals may require less bandwidth than analog video signals and may be appropriate for situations in which videos are to be transmitted over either high or low bandwidth pathways. Low bandwidth pathways may include telephone lines, the Internet, etc.

Video production system 14 may be used to provide a television wagering service that includes selected simulcast videos, video from studio 16, and graphic overlays to television distribution facilities 18 (for redistribution to user television equipment 22 and user computer equipment 20), to user computer equipment 20, and to user telephone equipment 32 (if user telephone equipment 32 has a display capable of displaying moving images). Television distribution facilities 18 may be any suitable facilities for supplying television to users, such as cable system headends, satellite systems, broadcast television systems, or other suitable systems or combinations of such systems. User computer equipment 20 may be any suitable computer equipment that supports an interactive wagering application. For example, user computer equipment 20 may be a personal computer. User computer equipment 20 may also be based on a mainframe computer, a workstation, a networked computer or computers, a laptop computer, a notebook computer, a handheld computing device such as a personal digital assistant or other small portable computer, etc.

Each of television distribution facilities 18 is typically located at a different geographic location. Users with user television equipment 22 may receive the television wagering service from an associated television distribution facility. User television equipment 22 may include, for example, a television or other suitable monitor. A television may be used to watch the television wagering service on a traditional analog television channel. User television equipment 22 may also include a digital or analog set-top box connected to a television distribution facility 18 by a cable path. A digital set-top box may be used to receive the television wagering service on a digital channel. If desired, user television equipment 22 may contain a satellite receiver, a WebTV box, a personal computer television (PC/TV), or hardware similar to such devices into which set-top box capabilities have been integrated. A recording device such as a videocassette recorder or digital recording device (e.g., a personal video recorder or digital video recorder based on hard disk drives or the like) may be used in user television equipment 22 to store videos. The recording device may be separate from or part of the other components of user television equipment 22.

User computer equipment 20 may receive the television wagering service using a video card or other video-capable equipment to receive analog or digital (e.g., moving picture experts group or MPEG) videos from a television distribution facility. User computer equipment 20 may also receive the television wagering service directly from video production system 14 using, for example, a modem link. If desired, the video for the television wagering service may be compressed (e.g., using MPEG techniques). This may be useful, for example, if the path to user computer equipment 20 is a modem connection using telephone links. If video production system 14 is only used to serve user computer equipment 20 without traditional analog television capabilities, video production system 14 may only need to supply such digitally-compressed video signals and not analog television signals.

Video clips of races and other simulcast information may be provided to users in the form of a television wagering service or by an interactive wagering service provided by the interactive wagering application. If desired, race-related videos may be provided to the user by using video production system 14 or other suitable equipment to route appropriate video clips from the simulcasts to the user in real time. Video clips may also be stored for later viewing. For example, one or more video servers located at racetracks 12, video production system 14, television distribution facilities 18, or other suitable locations may be used to store video clips. The stored videos may then be played back in real time or downloaded for viewing at user television equipment 22, user computer equipment 20, or user telephone equipment 32. The video clips may contain videos of races, commentary, interviews with jockeys, or any other suitable race-related information. If desired, real-time or stored videos may be provided from racetracks 12 directly to user television equipment 22, user computer equipment 20, or user telephone equipment 32 over the Internet or other suitable communications paths without involving video production system 14. Videos may also be provided by routing video signals through equipment located elsewhere in system 10. For example, videos may be routed through transaction processing and subscription management system 24.

Transaction processing and subscription management system 24 may contain computer equipment 26 and other equipment for supporting system functions such as transaction processing (e.g., handling tasks related to wagers, product purchasing, adjusting the amount of funds in user accounts based on the outcomes of wagers, video clip ordering, etc.), data distribution (e.g., for distributing racing data to the users), and subscriber management (e.g., features related to opening an account for a user, closing an account, allowing a user to add or withdraw funds from an account, changing the user's address or personal identification number, etc.). Databases within transaction processing and subscription management system 24 or associated with system 24 may be used to store racing data, wagering data and other transaction data, and subscriber data such as such as information on the user's current account balance, past wagering history, individual wager limits, personal identification number, billing addresses, credit card numbers, bank account numbers, social security numbers, etc. Using such databases may allow the user to access information more quickly and allows for central administration of the wagering service.

If desired, racing videos and other services may be provided using servers and other equipment located at transaction processing and subscription management system 24. For example, video clips may be provided to the user on-demand. Interactive advertisements may be provided to the user. When the user selects a desired advertisement, transaction processing and subscription management system 24 may provide additional information or other services related to the advertisement to the user.

Product ordering services may be implemented using computer equipment at transaction processing and subscriber management system 24 to handle orders and to assist in adjusting the appropriate account of the user accordingly. Orders may be fulfilled using merchandise fulfillment facilities 34. Merchandise fulfillment facilities 34 may be operated solely to provide merchandise fulfillment or may be associated with independently-operated mail-order or on-line businesses. Similar facilities may be used to allow users to order services.

Statistical racing data such as the post times for each race, jockey names, runner names and the number of races associated with each track, handicapping information (e.g., information on past performances such as the number of wins and losses for the past year, etc.), and weather conditions at various tracks may be provided by racing data collection and processing system 28. Some of the data may be collected from racetracks 12 and some may be provided by third party information sources such as Axcis Pocket Information Network, Inc. of Santa Clara, Calif. or other suitable data sources.

Racing data may also be provided from totalisators 30. Totalisators 30 are the computer systems that may be used to handle wagers made at the racetracks, made at off-track betting establishments, and made using interactive wagering system 10. Totalisators 30 generate wagering odds in real time. Totalisators 30 generate these odds based on information on which wagers are being placed (e.g., based on information on which wagers are being placed on races at racetracks 12). Totalisators 30 are available from companies such as Amtote International, Inc. of Hunt Valley, Md. Totalisators 30 may be associated with individual racetracks 12 or groups of racetracks 12. Totalisators 30 may communicate with one another using a communication protocol known as the Intertote Track System Protocol (ITSP). This allows totalisators 30 to share wagering pools. Totalisators 30 may provide racing data including information on the current races at racetracks 12, the number of races associated with each racetrack, win, place, and show odds and pool totals for each horse or other runner, and exacta, trifecta, and quinella payoff predictions and pool totals for every possible combination of runners. Totalisators 30 may also provide current odds and other real-time racing data for other types of wagers. Totalisators 30 may provide the time until post time for each race.

Totalisators 30 may provide race results, such as the order-of-finish list for at least the first three positions and payoff values versus a standard wager amount for win, place, and show, for each runner in the finish list. Payoff values may be provided for winning complex wager types such as exacta, trifecta, quinella, pick-n (where n is the number of races involved in the pick-n wager), and daily double. The payoff values may be accompanied by a synopsis of the associated finish list.

Totalisators 30 may also provide program information of the type typically provided in printed racing programs. Such program information may include early odds, early scratches, race descriptions (including the distance of each race and the race surface—grass, dirt, artificial turf, etc.), allowed class ratings (based on a fixed ratio of external criteria), purse value (payoff to winning runner), allowed age range of runners, and the allowed number of wins and starts for each runner.

If desired, some of the information provided to transaction processing and subscription management system 24 by totalisators 30 (such as the program information or other suitable racing data) may be provided by racing data collection and processing system 28. Similarly, some of the information provided to transaction processing and subscription management system 24 by racing data collection and processing system 28 may be provided by totalisators 30. Moreover, the foregoing examples of different suitable types of racing data are merely illustrative. Any suitable data related to racing may be provided to transaction processing and subscription management system 24 if desired.

Transaction processing and subscription management system 24 provides the racing data to users at user television equipment 22, user computer equipment 20, and user telephone equipment 32 for use in following race results and developing wagers. If desired, racing data may be provided to users using paths that do not directly involve transaction processing and subscription management system 24. For example, racing data may be provided from racing data collection and processing system 28 to user television equipment 22, user computer equipment 20, or user telephone equipment 32 using the Internet or other suitable communications paths.

User telephone equipment 32 may be a conventional telephone, a cordless telephone, a cellular telephone or other portable wireless telephone, or any other suitable telephone equipment. Users at user television equipment 22 and user computer equipment 20 may view information on the racing data on a television or other suitable monitor. Users at user telephone equipment 32 may listen to racing data using an interactive voice system. User telephone equipment 32 may be based on cellular telephones with displays. Users may view racing data displayed on such displays.

Users who wish to place wagers may establish an account at transaction processing and subscription management system 24. An account may also be established at one of totalisators 30. The user and the interactive wagering services may have their own bank accounts at financial institutions 38. A user may set up an account electronically by using user television equipment 22, user computer equipment 20, or user telephone equipment 32 to interact with the subscriber management functions of transaction processing and subscription management system 24. If desired, accounts may be established with the interactive wagering service with the assistance of customer service representatives at customer service facility 36. Customer service facility 36 may be at the same location as transaction processing and subscription management system 24, may be part of system 24, or may be located remote from system 24. Customer service representatives at customer service facility 36 may be reached by telephone. If user telephone equipment 32 is used to access the interactive wagering service, for example, user telephone equipment 32 may be used to reach the customer service representative using communications path 42. If user television equipment 22 or user computer equipment 20 is being used with the service, a telephone at the same location as that equipment may be used to reach the customer service representative.

The user's identity may be checked using social security number information or other identification information with the assistance of subscriber verification facility 40. The services of subscriber verification facility 40 are used to ensure that the user lives in a geographic area in which wagering is legal, that the user is of a legal age, and that the identification information (e.g., the user's social security number) matches the name provided by the user. If the user is using a cellular telephone or handheld computing device, the user's present physical location may be determined by determining which general part of the cellular telephone network is being accessed by the user or by using the cellular network or a handset-based location device such as a global positioning system (GPS) receiver in the body of the cellular telephone to pinpoint the user's location. This location information may be used to verify that the user is located in a geographic area where wagering is legal.

In a typical enrollment process, the user provides personal information to the interactive wagering service and provides funds with a credit card or funds from the user's bank account. The interactive wagering service sets up an account for the user at transaction processing and subscription management system 24 and directs one of totalisators 30 to set up a new account for the user at the totalisator. The totalisator is also directed to credit the user's account to reflect the amount of funds provided by the user. After the user places a wager and wins or loses, the totalisator adjusts the user's totalisator account to reflect the outcome of the wager. The totalisator may periodically inform the interactive wagering service of the adjusted balance in the user's account. This may be accomplished using any suitable technique (e.g., periodically, continuously, on-request, etc.). For example, reports may be collected periodically (e.g., once a day in an end-of-day report) and provided to the interactive wagering service to reconcile the account balances at transaction processing and subscription management system 24 with the account balances at totalisators 30.

If the user makes a balance inquiry, the inquiry may be passed to the appropriate totalisator by transaction processing and subscription management system 24. If the user is charged a fee for subscribing to the service, the service may debit the fee from the user's account at the transaction processing and subscription management system 24.

The accounts at totalisators 30 and transaction processing and subscription management system 24 are typically maintained separately, because the business entities that operate totalisators 30 and transaction processing and subscription management system 24 are independent. If desired, financial functions related to opening and maintaining user accounts and the like may be handled using computer equipment at another location such as one of financial institutions 38 or other location remote from totalisators 30 and system 24. Such financial functions may also be implemented primarily at a totalisator 30 or primarily at the transaction processing and subscription management system 24 if desired.

Users at user television equipment 22, user computer equipment 20, and user telephone equipment 32 may place wagers by providing wagering data and otherwise interacting with transaction processing and subscription management system 24. The interactive wagering service may provide a user at user television equipment 22, user computer equipment 20, or user telephone equipment 32 that has display capabilities with screens containing various racing data. For example, the user may be presented with screens that allow the user to view the current odds for horses in an upcoming race at a given track.

The service may provide the user with interactive screens containing menus and selectable options that allow the user to specify the type of wager in which the user is interested and the desired wager amount. With a set-top box arrangement, for example, the user may use a remote control or wireless keyboard to navigate the various menus and selectable options. With a personal computer, the user may use a keyboard, mouse, trackball, touch pad, or other suitable input or pointing device. With a cellular telephone with a display, the user may use buttons on the telephone. When the user has made appropriate selections to define a desired wager, the user television equipment, user computer equipment, or user telephone equipment may transmit wagering data for the wager to transaction processing and subscription management system 24.

Users with telephones may also interact with the service using an interactive voice response system located at transaction processing and subscription management system 24. The interactive voice response system may present menu options to the user in the form of audio prompts (e.g., "press 1 to select a $2 wager amount," etc.). The user may interact with the service be pressing the corresponding buttons on a touch tone telephone. User telephone equipment 32 that is based on cellular telephones allows the user to interact with the wagering service in this way. User telephone equipment 32 that is based on cellular telephones with messaging and display capabilities also allows the user to interact visually with the interactive wagering service.

The components of system 10 may be interconnected using various communications paths 44. Communications paths 44 may include satellite paths, coaxial cable paths, fiber-optic paths, twisted pair paths, other wire or cable-based links, wireless paths through free space, or any other suitable paths or combination of such paths. Communications over paths 44 may involve analog transmissions, digital transmissions, wireless transmissions, microwave transmissions, radio-frequency transmissions, optical transmissions, audio transmissions, or any other suitable type of transmissions or combination of such transmissions. Communications may involve Internet transmissions, private network transmissions, packet-based transmissions, television channel transmissions, transmissions in the vertical blanking interval of a television channel or on a television sideband, MPEG transmissions, etc. Communications may involve wireless pager or other messaging transmissions. Communications paths 44 may include cable connected to cable modems, digital subscriber lines, integrated services digital network (ISDN) lines, or any other suitable paths. Examples of suitable communications paths are described below. Those examples are, however, merely illustrative. Any of the communications path arrangements described above or other suitable arrangements may be used if desired.

Communications paths that carry video and particularly uncompressed analog video or lightly-compressed or full-screen digital video generally use more bandwidth than communications paths that carry only data or that carry partial-screen digital video. For example, if it is desired to transmit high-quality simulcasts of races from racetracks 12 to video production system 14, analog or digital videos may be transmitted from racetracks 12 to video production system 14 over path 44*a* using satellite links. Video may be transmitted from studio 16 to video production system 14 over path 44*b* using a satellite link or a high-speed terrestrial path such as a fiber-optic path. Studio 16 may also be located at the same site as video production system 14, thereby avoiding the need for a long-haul transmission path. Videos may be transmitted from video production system 14 to user computer equipment 20 over path 14*c* using a modem link (using, for example, a digital subscriber line, a telephone network link, a wireless link etc.) The modem link may be made over a private network.

A user with a cable modem may connect a personal computer or other such user computer equipment 20 to an associated cable system headend using path 44*d*. (The headend in such an arrangement would be one of the television distribution facilities 18 shown in FIG. 1.) The user may then receive videos from the headend via cable modem. Videos may be provided to the headend over path 44*e* using a network link, fiber optic links, cable links, microwave links, satellite links, etc. A user with a set-top box or similar device (shown in FIG. 1 as user television equipment 22) may also receive videos from a cable system headend using a cable modem or other such communications device over path 44*f*. In addition, a user with user television equipment may receive videos over the Internet or a private network using a telephone-based modem or other such communications device using path 44*g*. In a system with distributed processing, interactive wagering services may be provided using a television distribution facility 18 that includes equipment that supplements or replaces at least some of the equipment at transaction processing and subscription management system 24.

If desired, user television equipment 22 or user computer equipment 20 may receive analog or digital videos from an associated television distribution facility over the communications paths normally used to distribute television programming (e.g., paths 44*f* and 44*d*). For example, videos may be received as part of a dedicated interactive wagering service television channel. If videos are provided as digital signals (e.g., MPEG signals), 10 or more digital videos may be carried on a single analog channel (or one digital video may be carried on one-tenth of the bandwidth of an analog channel). If the videos are not full-screen videos, even more videos may be simultaneously provided without a loss of image quality.

Racing videos may be provided to user telephone equipment 32 over a partially-wireless telephone Internet link or other telephone link using path 44*n*.

If desired, racing data may accompany the racing videos along any of these paths. Moreover, racing videos may be provided by routing them directly from racetracks 12 to user television equipment 22, user computer equipment 20 (e.g., over the Internet or a private network, etc.), or user telephone equipment 32. Racing videos may also be provided by routing them through transaction processing and subscription management system 24. If a cellular telephone or portable computing device has sufficient display capabilities to support moving images, racing videos may be displayed. Such videos may be provided using any suitable path, such as a direct path from racetracks 12, a path through video production system 14 or other suitable video processing equipment, through a hub such as transaction processing and subscription management system 24, etc. Racing videos may be provided in real time or may be recorded for later distribution. Videos that are not provided in real-time may be downloaded by user television equipment 22, user computer equipment 20, a cellular telephone, or other suitable user equipment at a lower data rate than would otherwise be required and may be downloaded in the background if desired. Such videos may also be provided to the user at real-time video rates for direct viewing by the user.

Racing data and other information related to the interactive wagering service may be provided to users over paths connected to transaction processing and subscription management system 24. For example, racing data and other data for the service may be provided to user computer equipment 20 over path 44*h* using a modem link. Path 44*h* may be a private network path or an Internet path. Path 44*h* may use telephone lines, digital subscriber lines, ISDN lines, wireless data paths, or any other suitable type of communications links. User television equipment 22 may receive data for the wagering service over communications path 44*i*, which may be a telephone line, digital subscriber line, ISDN line, or other suitable type of communications path and which may use a private network path or an Internet path, etc.

Data for the wagering service may be provided to users of the interactive wagering application via communications path 44*j* and paths 44*f* and 44*d*. Communications path 44*j* may be provided over a private network, using the public telephone network, using satellite links, or any other suitable type of links. Data from paths such as path 44*j* may be routed to paths such as paths 44*f* and 44*d* directly by associated television distribution facilities 18, or may be buffered at television distribution facilities 18 if desired. Paths 44*f* and 44*d* may include coaxial cable and use of paths 44*f* and 44*d* may involve the use of cable modems or the like. If data is provided over path 44*j* and path 44*f* or path 44*d* using an Internet protocol, a web browser or similar software running on user television equipment 22 or user computer equipment 20 may be used to access the data. Such software may be integrated into the interactive wagering application or may be used separately. Software may also be used to view videos and may be used on other platforms (e.g., advanced cellular telephones) if desired.

The communications paths 44*k* that are used to connect various other components of the system typically do not carry high-bandwidth video signals. Accordingly, paths 44*k* may be telephone-like paths that are part of the Internet or a private network. Such paths and various other paths 44 may be dedicated connections for security, reliability, and economy.

User telephone equipment 32 may receive information for the wagering service via path 44*m*. If user telephone equipment 32 is a standard (non-cellular) telephone, such information may be in the form of audio prompts ("press 1 to place a wager") and audio racing data ("the current win odds for horse 2 are 5-1"). Transaction data processing and subscription management system 24 may contain interactive voice response equipment that provides such information to the user and that responds to touch-tone signals from the user when the user responds to prompts by pressing buttons on the user's telephone.

If user telephone equipment 32 is a cellular telephone, racing data and other information for the interactive wagering service may be provided to the user by using a cellular wireless connection as part of path 44*m*. Users with cellular telephones may be provided with audio prompts using an interactive voice response system located at transaction processing and subscription management system 24 to which the users may respond by pressing cellular telephone buttons to generate touch-tone signals.

Racing data and other information for the interactive wagering service may be provided to cellular telephones in the form of alphanumeric messages. Such messages may be transmitted to the user by using paging or other alphanumeric messaging formats or any other suitable data communications scheme. If desired, data may be provided to the cellular telephones over the voice channel and decoded by the cellular telephone using modem circuitry or other suitable circuitry. Data may also be provided using any other suitable cellular or wireless path. Regardless of the way in which racing data and other information for the interactive wagering service are provided to the cellular telephone, such information may be provided to the user by displaying it on the cellular telephone display screen or by presenting it in audible form through the speaker of the cellular telephone.

Racing data and other interactive wagering service information for the users may be provided in one or more continuous data streams, may be provided periodically (e.g., once per hour or once per day), or may be provided using a client-server arrangement in which data is requested by a client processor (e.g., user television equipment 22, user computer equipment 20, user telephone equipment 32, or any other such equipment) from a server (e.g., a server implemented using computer equipment 26 at transaction processing and subscription management system 24 or computer equipment at another suitable location). Videos may also be provided using any of these techniques.

A return communications path between the user and the interactive wagering service may be used to allow the user to place wagers and otherwise interact with the interactive wagering service. For example, a user with a standard telephone or a cellular telephone may interact with the service by pressing touch-tone keys on the telephone in response to audio prompts provided by an interactive voice response system at transaction processing and subscription management system 24. If desired, users may call customer service representatives at customer service facility 36 and place wagers with manual assistance. The user of a cellular telephone may interact with the wagering service by selecting menu options and otherwise interacting with information displayed on the cellular telephone. When a selection is made, software implemented on the telephone may be used to assist the user in transmitting appropriate data (e.g., wagering data) to the wagering service. Such data may be transmitted using any suitable technique. For example, data may be transmitted using a wireless data link that is separate from the cellular voice channels. Data may also be transmitted over the voice channel (e.g., using a modem built into the cellular telephone, by automatically generating touch-tone signals that may be recognized by the interactive voice response system at transaction processing and subscription management system 24, or using any other suitable arrangement). These approaches may be used even if the user receives racing data and other information for the service using a platform other than a telephone-based platform.

Users with user television equipment 22 may interact with the service by sending data (e.g., wager data) to transaction processing and subscription management system 24 using path 44*i* or using paths 44*f* and 44*j*. Users with user computer equipment 20 may send data (e.g., wager data) to transaction processing and subscription management system 24 via path 44*h* or paths 44*d* and 44*j*. Users at any user equipment may send data for the service to locations other than transaction processing and subscription management system 24. For example, the user may provide information directly to customer service facility 36, etc.

If desired, the user may send data to the service at transaction processing and subscription management system 24 using different paths than those used to receive data from transaction processing and subscription management system 24. For example, racing data may be received at user television equipment 22 via paths 44*j* and 44*f*, whereas data may be sent by the user from user television equipment 22 to transaction processing and subscription management system 24 using path 44*i*, etc. Moreover, the paths used to receive certain video information may be different from those used to receive racing data. For example, user television equipment 22 may receive racing videos using path 44*f*, but may receive racing data using path 44*i*. These examples are merely illustrative. Any suitable combination of paths may be used to distribute racing data and other information for the interactive wagering service, any suitable combination of paths may be used to receive videos, and any suitable combination of paths may be used to send data to the wagering service.

If desired, the user may interact with the wagering service using more than one platform. For example, the user may place a wager using a cellular telephone while the user is driving home. When the user arrives home, the user may determine the outcome of the wager by watching a video of the race on user television equipment. Later in the day, the user may check the user's account balance using a personal computer. This is merely an illustrative example. The various wagering platforms may be used in any suitable combination.

Although system 10 has been described in the context of a system that supports multiple wagering platforms, system 10 may support fewer platforms if desired. For example, aspects of the invention may be implemented using a system 10 that only supports cellular telephone wagering or wagering using handheld computer devices. If desired, system 10 may be configured so that it does not support personal computer wagering., wagering with standard telephones, or wagering with user television equipment. The system may support cellular telephones and/or handheld computing devices such as personal digital assistants, palm-sized computers, etc. in combination with any other suitable platform.

The features of the present invention are sometimes described herein in the context of an interactive wagering application implemented on user television equipment. This is only illustrative. An interactive wagering application implemented on any suitable platform (user computer equipment, user telephone equipment, etc.) may be used to provide such features if desired. In computer arrangements, on-screen options may be selected by clicking on them using a mouse pointer or other pointing arrangement. In set-top box arrangements, on-screen options may be made larger than they appear in computer-based arrangements to accommodate the greater viewing distance from which televisions are typically operated. Options may be selected by highlighting them using remote control arrow keys and by pressing an appropriate key such as an OK or enter or select key. In cellular telephone arrangements and handheld computer arrangements, options and information may be displayed using smaller screens than are typically available on personal computer or set-top box arrangements. To accommodate the smaller screen size, options that might otherwise be presented on a single screen may be displayed using multiple screens or layered menus. Options may be selected by highlighting them using navigation keys and pressing an appropriate select button on the cellular telephone or handheld computing device or by using a pen-based interface or the like.

The interactive wagering application may be implemented using application software that runs primarily on user television equipment, user computer equipment, user telephone equipment, or other local platform or using a remote server or other computer that is accessed from the local platform. Arrangements in which interactive wagering services are implemented using software on remote computers that is accessed on-demand from local platforms may be referred to as client-server arrangements. Such client-server arrangements may be used to allow client processes on set-top boxes or other platforms to access server processes running on servers located at cable system headends or other television distribution facilities 18 (FIG. 1). Regardless of the type of system architecture or platform used, the software that supports the interactive wagering service features described herein may be referred to as an interactive wagering application.

In a set-top box environment, the system may allow the user to launch the application by pressing a menu option in an interactive television program guide or other set-top box application or menu. If desired, the application may be launched automatically whenever the user tunes to a particular channel (e.g., the wagering-related television channel). After the user has tuned to this channel, the system may display an interactive icon on the user's television screen that indicates that the interactive wagering application is available. If the user presses an "OK" remote control key, the system may launch the application.

In a computer-based system, the user may access the interactive wagering application by browsing to an Internet web site or a site on a private network.

Systems based on cellular telephones or the like may be launched by selecting an appropriate on-screen menu option presented on the display of the cellular telephone.

Figure 2:
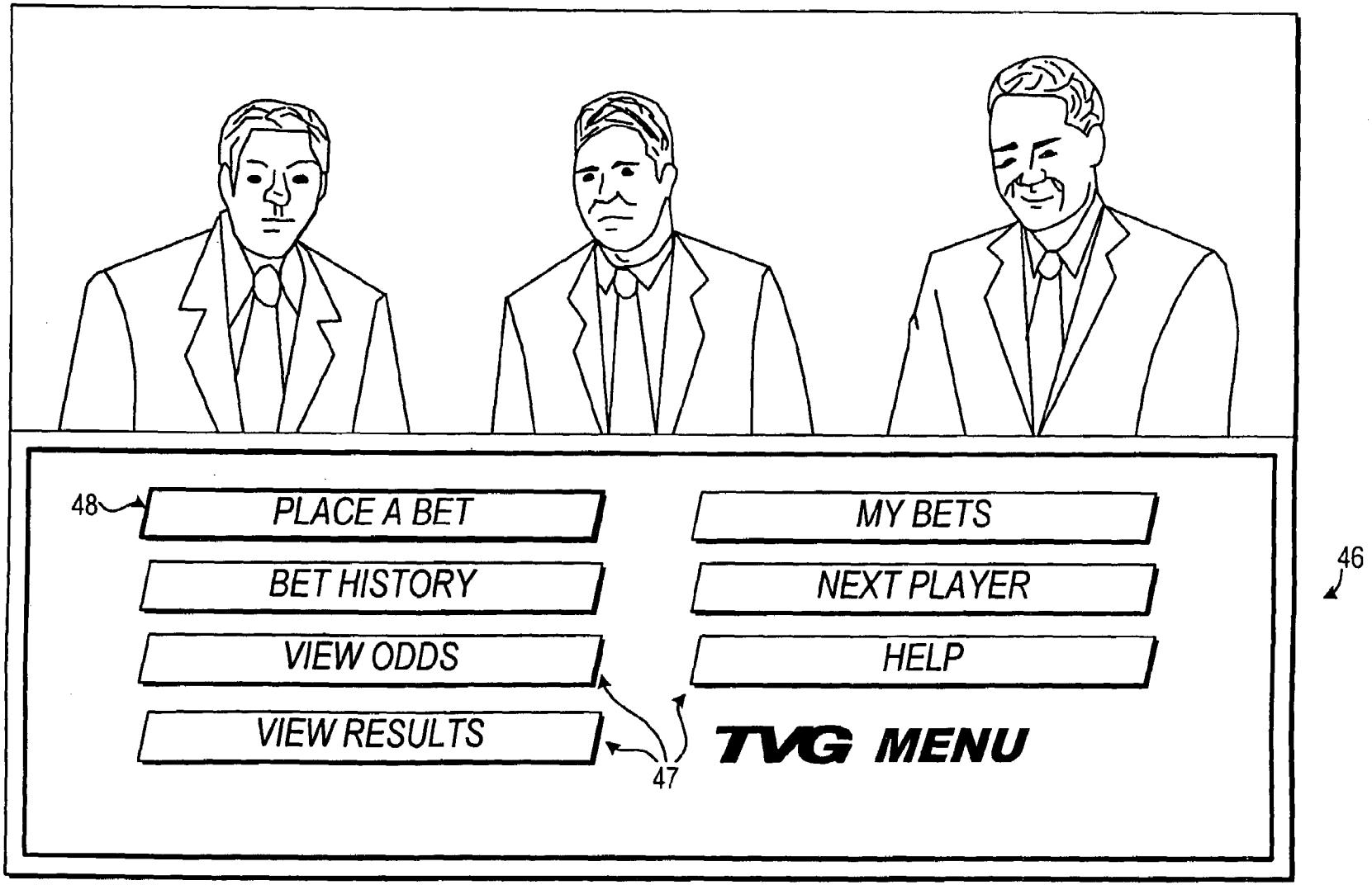
FIG. 2 shows an illustrative menu screen that may be provided as an overlay on top of a wagering-related television channel in accordance with the present invention.

An illustrative menu screen 46 that may be provided by the interactive wagering application is shown in FIG. 2.

Screen 46 and the screens shown in FIGS. 3–12 are examples of screens that may be displayed on a satellite receiver set-top box or other user television equipment 22. The format and contents of such screens may be modified to accommodate different platforms such as user computer equipment and user telephone equipment platforms if desired. Moreover, the information and options of the screens of FIGS. 2–12 may be provided using audio prompts to accommodate telephone-based wagering from touch-tone telephones.

As shown in FIG. 2, menu screen 46 may include a number of different options 47. For example options may be provided to place a bet, to view a bet history, to view handicapping information such as odds, to view race results, to view a list of the user's wagers, to move to the next player (when multiple players are wagering at a single session), or to obtain help. Screen 46 may be displayed as an overlay on top of a wagering-related television channel provided, for example, by video production system 14 of FIG. 1.

The user may make on-screen selections by using remote control keys or other suitable user interface to place a highlight region such as highlight region 48 of FIG. 2 on top of a desired selection and pressing an OK or enter or select key on the remote control.

Figure 3:
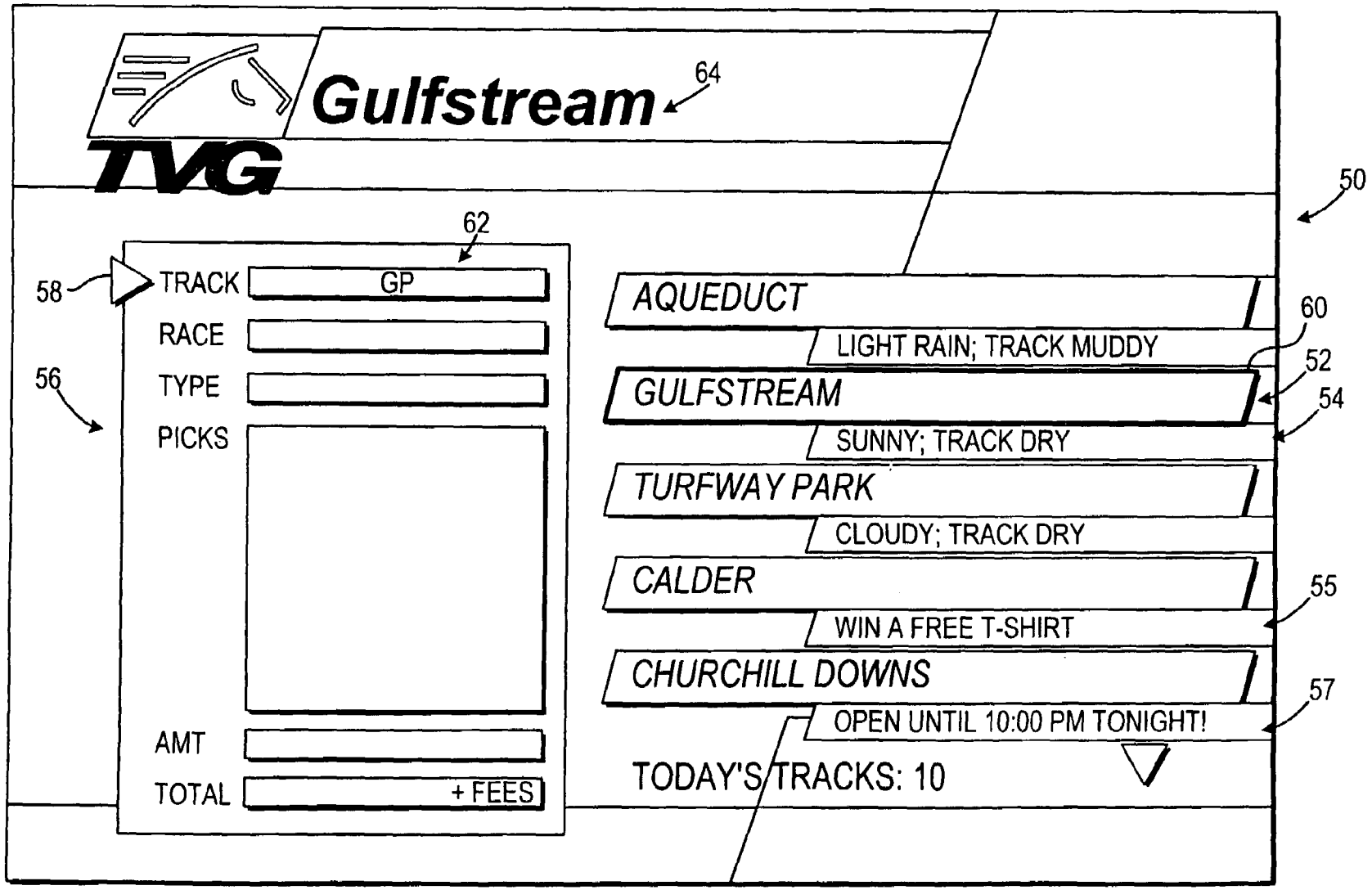
FIG. 3 shows an illustrative racetrack selection screen that may be provided by the interactive wagering application in accordance with the present invention.

When the user selects the place a bet option of FIG. 2, the interactive wagering application may display a screen such as racetrack selection screen 50 of FIG. 3. As shown in FIG. 3, the racetrack name field for each selectable racetrack option has a corresponding information area. For example, racetrack name field 52 has a corresponding information area 54. In the example of FIG. 3, the content of information area 54 (sunny; track dry) corresponds to the current weather and track conditions at the track listed in racetrack name field 52 (Gulfstream). This provides the user with easily-accessible information on current track conditions before the user decides to place a wager at a particular track.

Information areas may contain other information besides weather and track conditions. For example, information area 55 contains a promotion (win a free t-shirt) that is taking place at the Calder track. Information area 57 contains information on how late the Churchill downs track is open. Information areas may also be used to provide information on track closures (e.g., due to poor weather conditions), racetrack directions (e.g., driving directions to the racetrack), information on upcoming events, etc.

Screen 50 may contain a wagering ticket 56. Indicator 58 may be used to visually indicate which portion of the wagering ticket 56 is currently being filled in. In the example of FIG. 3, the user is selecting a desired racetrack for a wager. The user may select desired racetracks using highlight region 60. When, for example, the user highlights the racetrack option for the Gulfstream track, the code 62 (GP) for the Gulfstream track may be added to ticket 56 and the name Gulfstream may be displayed in region 64.

Figure 4:
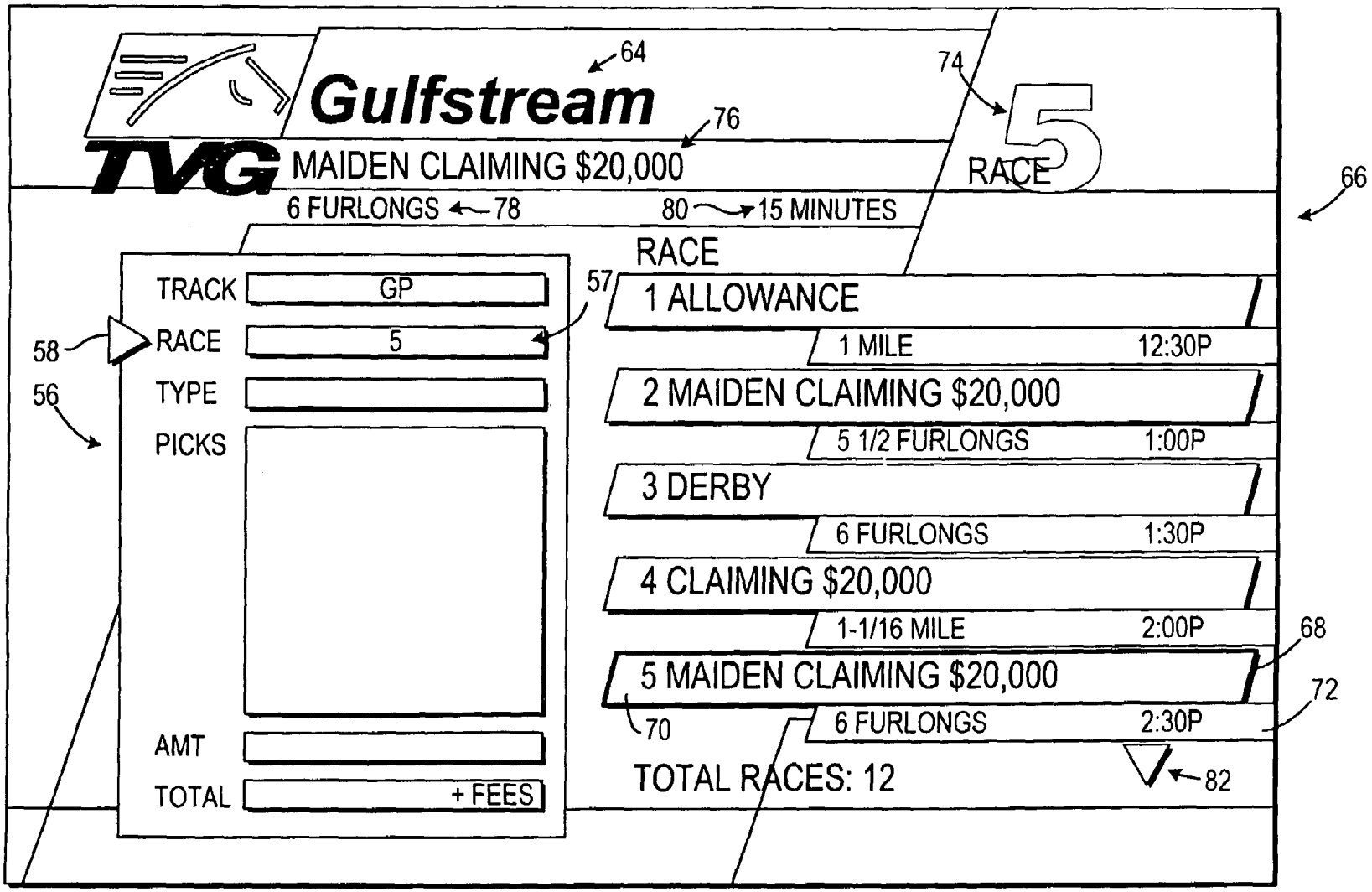
FIG. 4 shows an illustrative race selection screen that may be provided by the interactive wagering application in accordance with the present invention.

After the user has selected a track, the interactive wagering application may present a screen such as race selection screen 66 of FIG. 4 to the user. In screen 66, the user may move highlight region 68 on top of a desired selectable race option. In the example of FIG. 4, the user has positioned highlight region 68 on race 5. Race description field 70 contains information describing race 5 (i.e., it is a maiden claiming race for $20,000). Information on various types of races may be included in the race description field for each race option. For example, information may be included in the race option that identifies the race as being an allowance race, a maiden claiming race, a claiming race, a maiden claiming race, etc. Each race description field in screen 66 has a corresponding information area. For example, race description field 70 has corresponding information area 72. The information areas may be used for any suitable content. For example, the information areas may contain information on the length of the race and the post time of the race. In the example of FIG. 4, race 5 is described in information area 72 as being a race of 6 furlongs in length and having a post (start) time of 2:30 PM.

When the user highlights a desired race, the race number may be added to ticket 56 in region 57 and indicator 58 may be positioned to make it clear the user is selecting a race. The race number for the currently highlighted race may be displayed in region 74. The description of the race may be displayed in region 76. The race length may be displayed in region 78. The time until post (e.g., 15 minutes in the example of FIG. 4) may be displayed in region 80. If desired, the user may scroll to additional races using, for example, a remote control down arrow key, as indicated by arrow 82.

Figure 5:
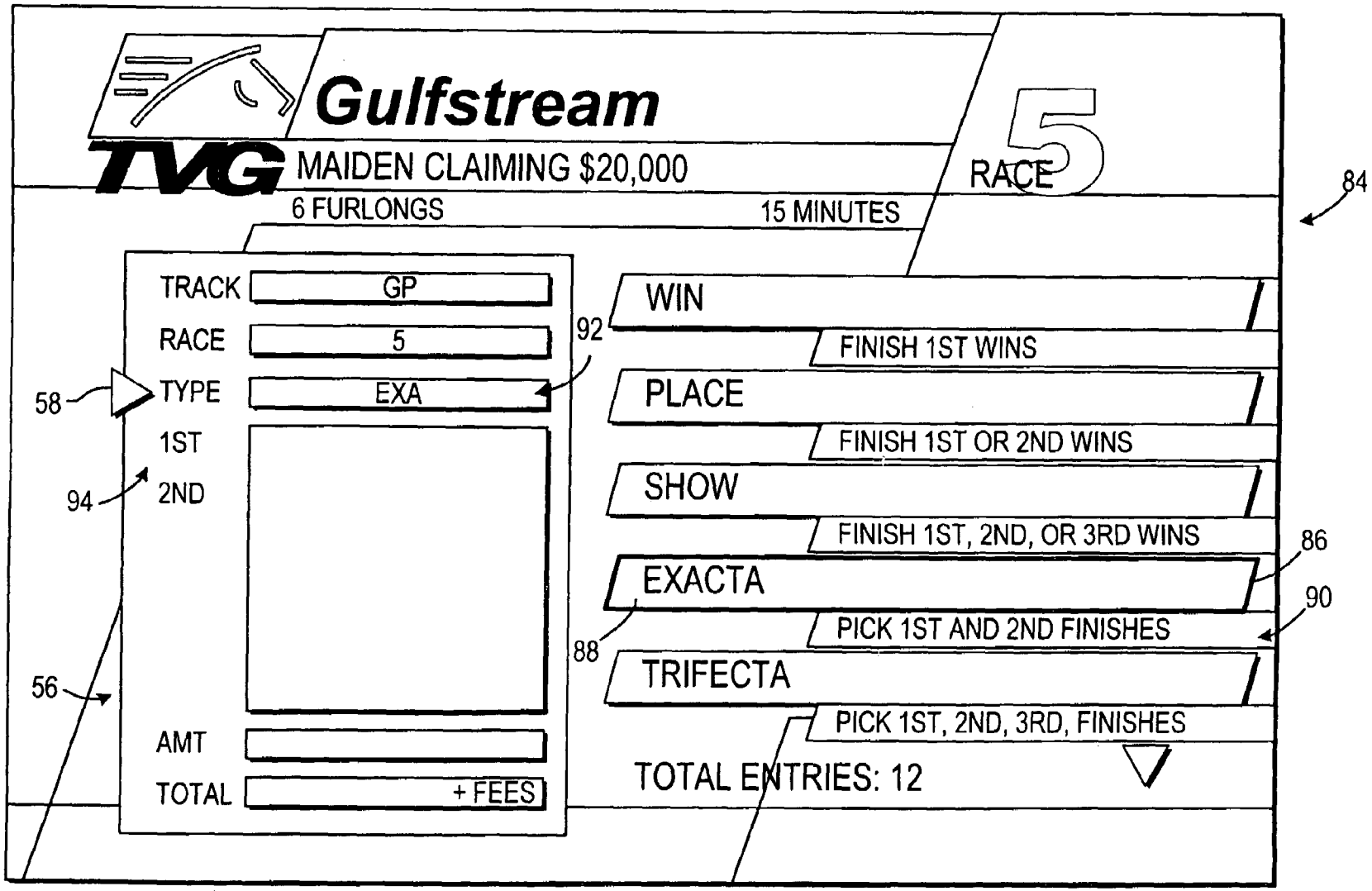
FIG. 5 shows an illustrative wager type selection screen that may be provided by the interactive wagering application in accordance with the present invention.

When the user selects a desired race, the interactive wagering application may display a wager type selection screen such as screen 84 of FIG. 5. The user may place highlight region 86 on top of a desired selectable wager type option (e.g., win, place, show, exacta, trifecta, etc.). The wager types are listed in wager type fields such as wager type field 88. The wager described in wager type field 88 is an exacta. A corresponding information area may be provided for each wager type field. In the example of FIG. 5, wager type field 88 (exacta) has a corresponding information area 90. The information in information area 90 is a wager type description for the corresponding wager type listed in wager type field 88. If desired, other suitable information may be included in information areas such as information area 90.

Wager ticket 56 may be updated to reflect the highlighted wager type (exacta). This information is displayed in region 92. Indicator 58 may be moved to indicate that the user is selecting the wager type. Moreover, runner indicators 94 may be provided. The number of runner indicators 94 that are provided depends on the wager type. For a win wager, one runner indicator 94 is displayed, because a win wager only involves a single runner. For an exacta wager (the subject of the example of FIG. 5), two runner indicators 94 are displayed, one for the first place finisher and one for the second place finisher.

Figure 6:
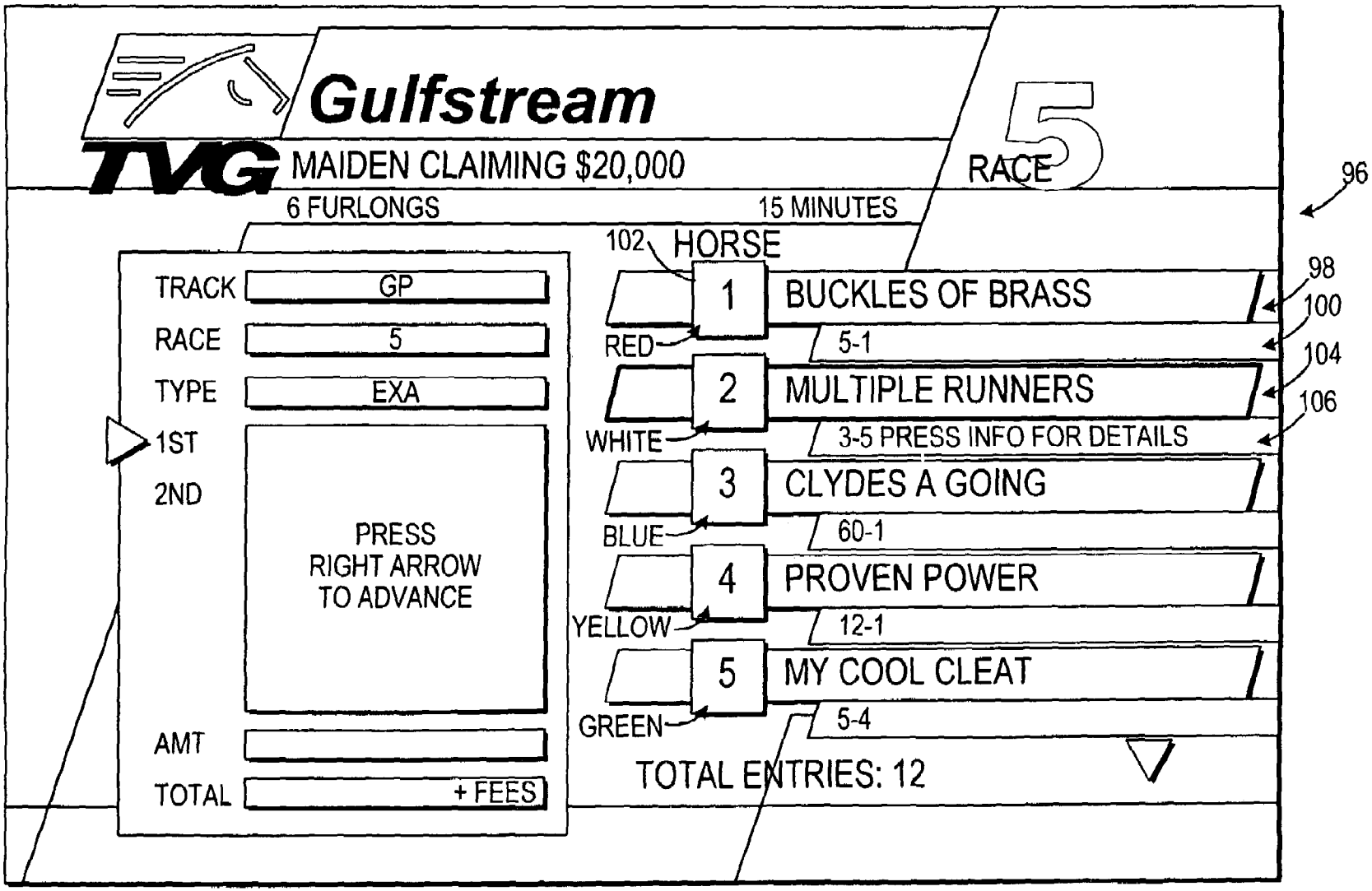
FIG. 6 shows an illustrative horse selection screen that may be provided by the interactive wagering application in accordance with the present invention.

When the user selects the desired wager type, the interactive wagering application displays a horse selection screen such as screen 96 of FIG. 6. As shown in FIG. 6, the names of the horses are listed in selectable horse option name fields such as horse name field 98 and corresponding information areas such as information area 100 are used to display information on the current win odds for each horse. If desired, other information, such as information on the horse's jockey or trainer, etc. may also be provided in the information areas.

Horse numbers such as horse number 102 are provided adjacent to each horse name. As shown in FIG. 6, each horse number may be a different color. In particular, each horse number may be displayed using the same colors that are used for that horse's saddle blankets in the actual race. The saddle blanket coloring convention is used to assist wagerers in visually identifying their horse during a race, without being required to discern the individual runner numbers in the race video. Providing this information on the horse selection screen 96 assists the user in remembering the proper colors for their horses.

If a betting interest involves more than one horse, there may be a horse number (e.g., horse number 2 in the example of FIG. 6) that has more than one associated runner. An indication 104 (e.g., "multiple runners") may be displayed in the horse name field of the selectable horse option for such entries. Information instructing the user to press an info button or the like may be provided in the corresponding information area 106.

Figure 7:
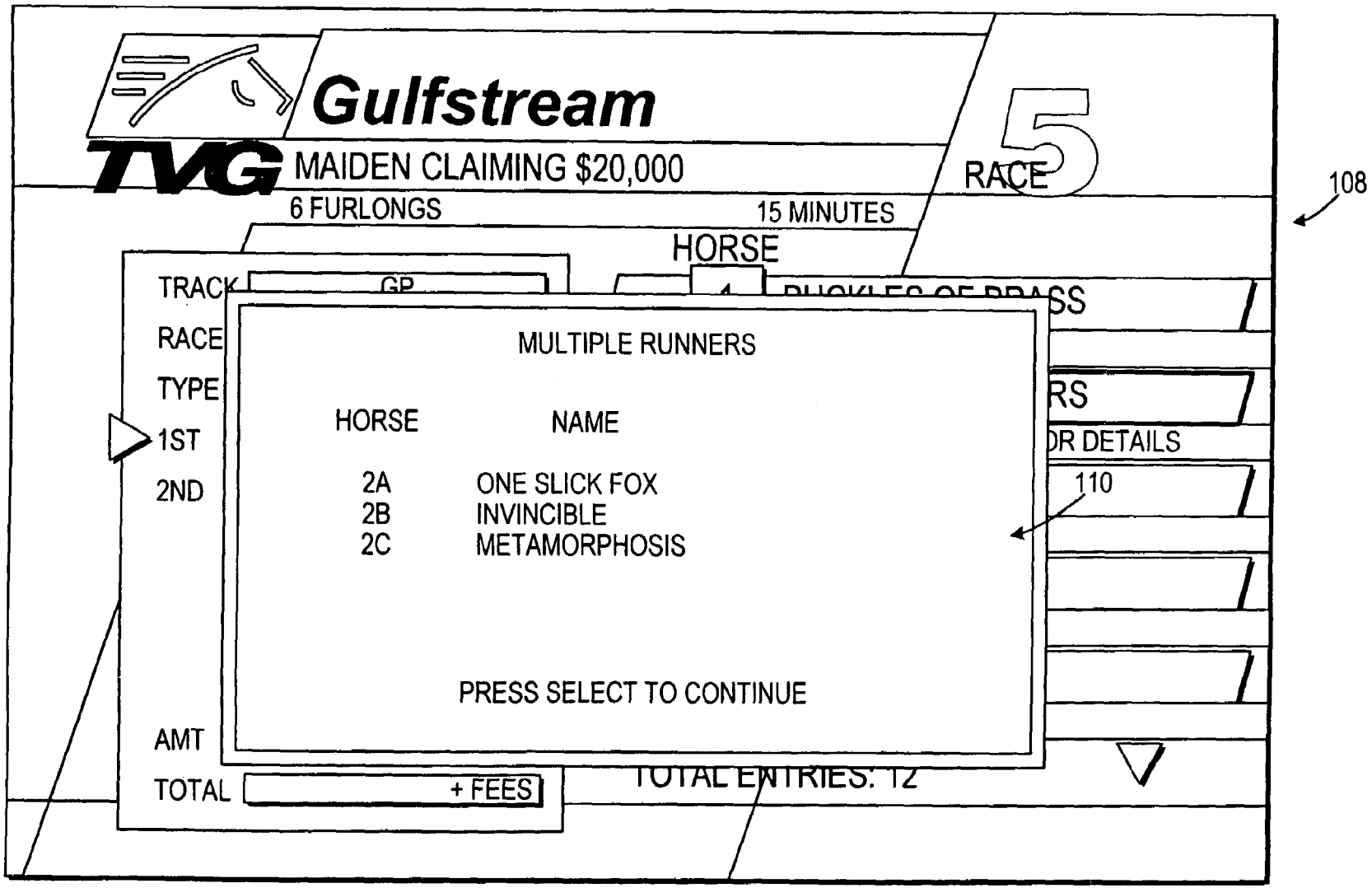
FIG. 7 shows an illustrative multiple runners information region that may be provided by the interactive wagering application in accordance with the present invention.
Figure 8:
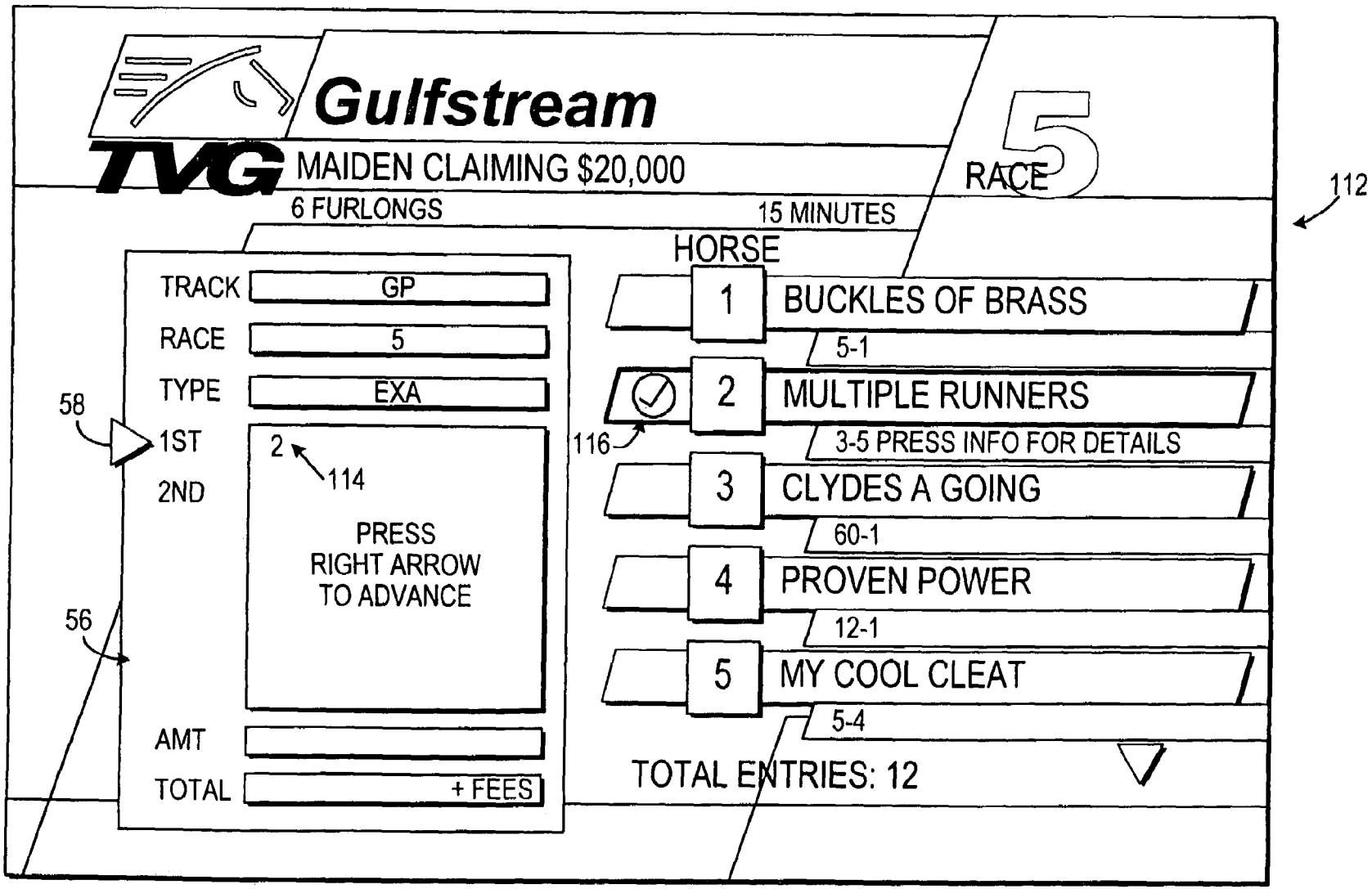
FIG. 8 shows an illustrative wagering ticket that may be provided by the interactive wagering application after the first horse in an exacta wager has been selected in accordance with the present invention.

When the user highlights the multiple runners entry of FIG. 6 and presses info, the interactive wagering application may display a screen such as screen 108 of FIG. 7 in which additional information 110 on each of the runners associated with horse number 2 is provided.

After the user selects each horse, the wagering ticket is updated. If, for example, the user selects horse number 2, the interactive wagering application may display a screen such as screen 112 of FIG. 8 in which wagering ticket 56 has been updated to include information 114 on the selected horse (i.e., horse No. 2). Indicator 58 points to the current runner position that is being selected (e.g., the first place finisher in the example of FIG. 8). In addition, an indicator such as check indicator 116 may be provided to make it clear which horse has been selected.

Figure 9:
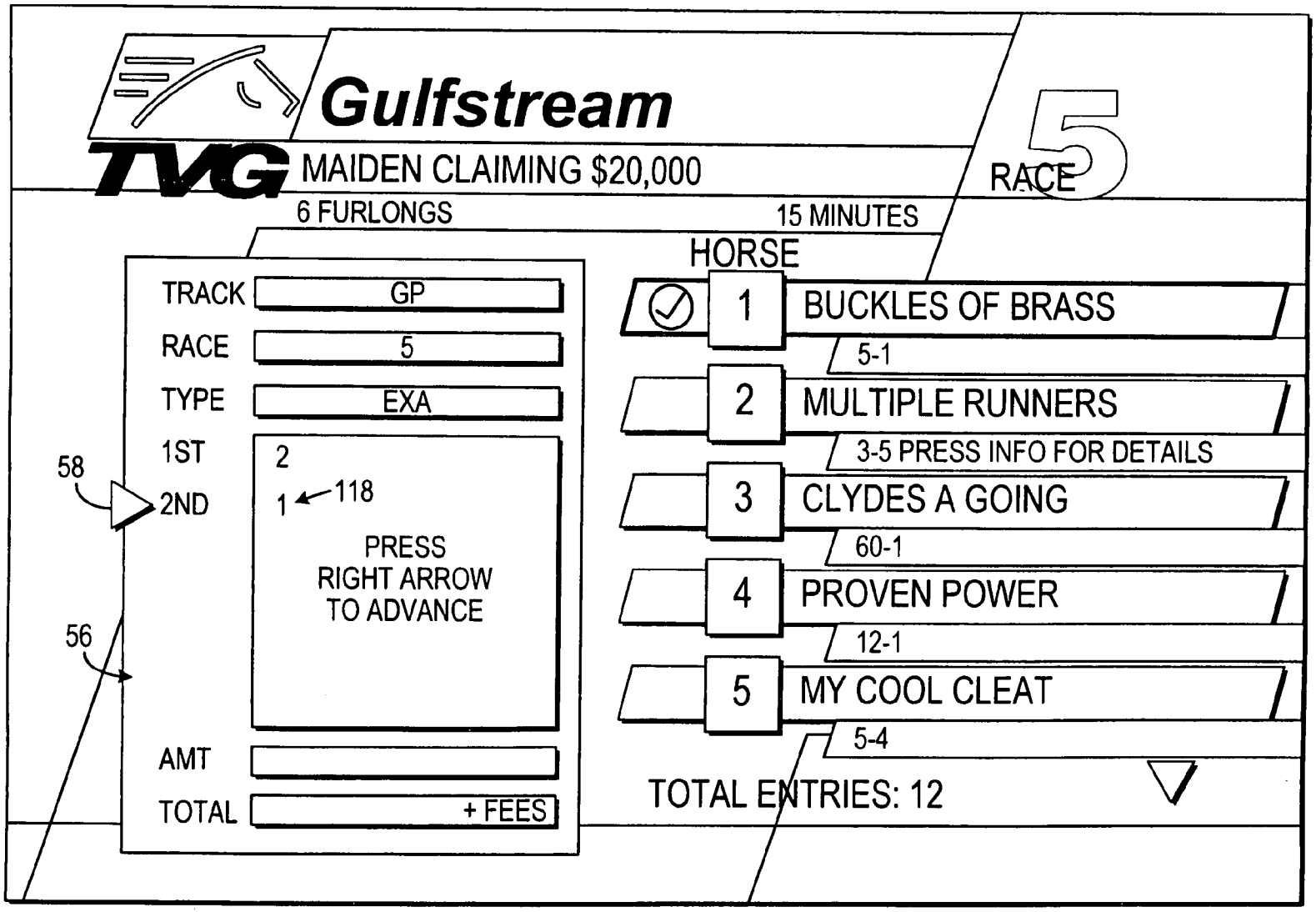
FIG. 9 shows an illustrative wagering ticket that may be provided by the interactive wagering application after the first and second horses in the exacta wager have been selected in accordance with the present invention.

After the user selects a first place finisher, the user may select a second place finisher, as shown in FIG. 9. In the example of FIG. 9, the user has highlighted horse number 1 and this information 118 is reflected in wager ticket 56. The position of indicator 58 may also be updated.

Figure 10:
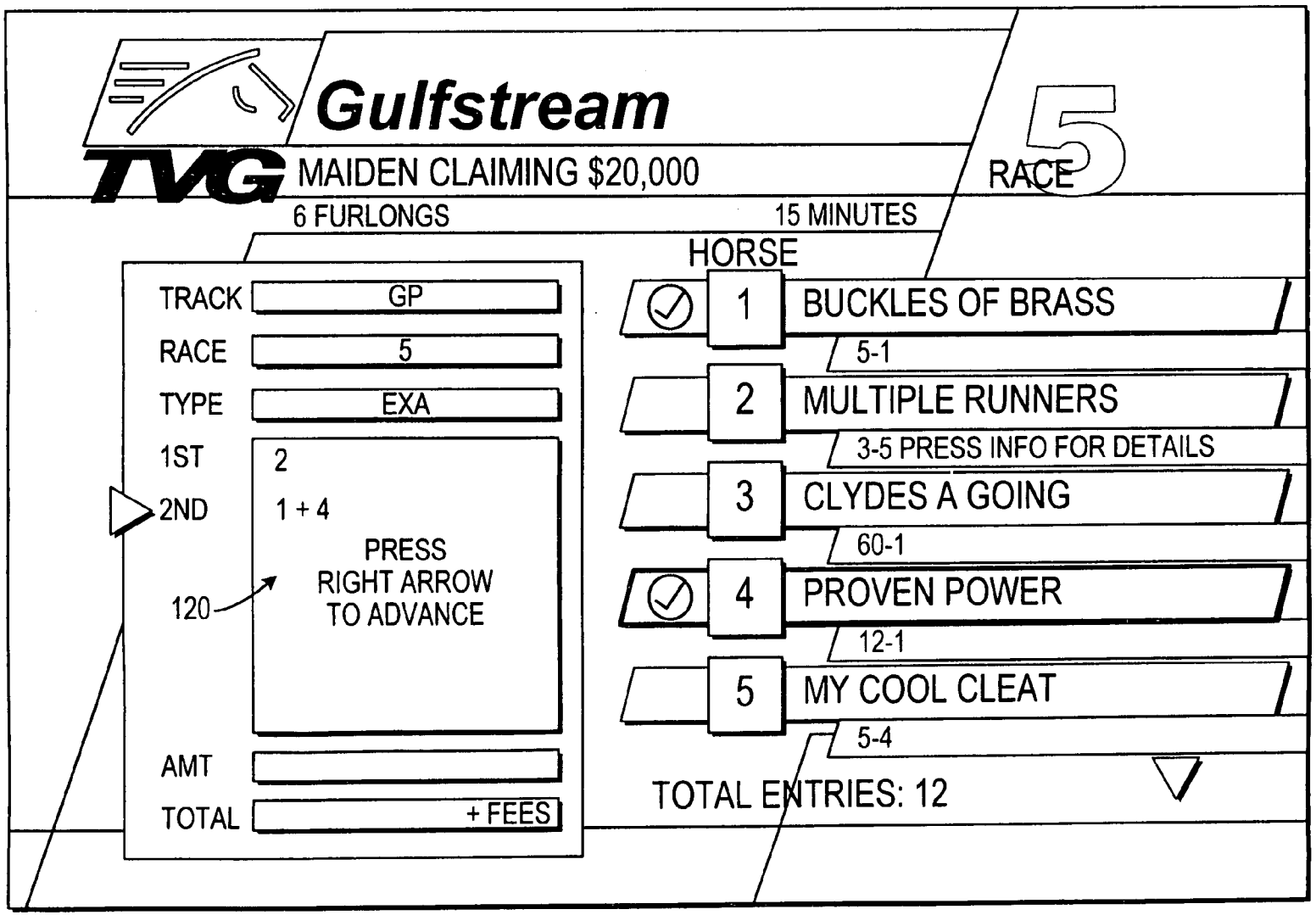
FIG. 10 shows an illustrative wagering ticket that may be provided by the interactive wagering application after an additional second horse (No. 4) has been selected in accordance with the present invention.

Although selecting a first and second place finisher completes an exacta wager, the user may wish to add additional runners to either the first or second place finisher slots. This in effect allows the user to place a second wager similar to the first wager. As shown in FIG. 10, for example, the user has added an additional runner (horse No. 4) to the second place finisher's slot for the exacta wager. When the user has finished adding runners, the user may press a remote control right arrow key to move to the next screen, as indicated by message 120. The interactive wagering application may then present the user with a wager amount selection screen such as wager amount selection screen 122 of FIG. 11.

Figure 11:
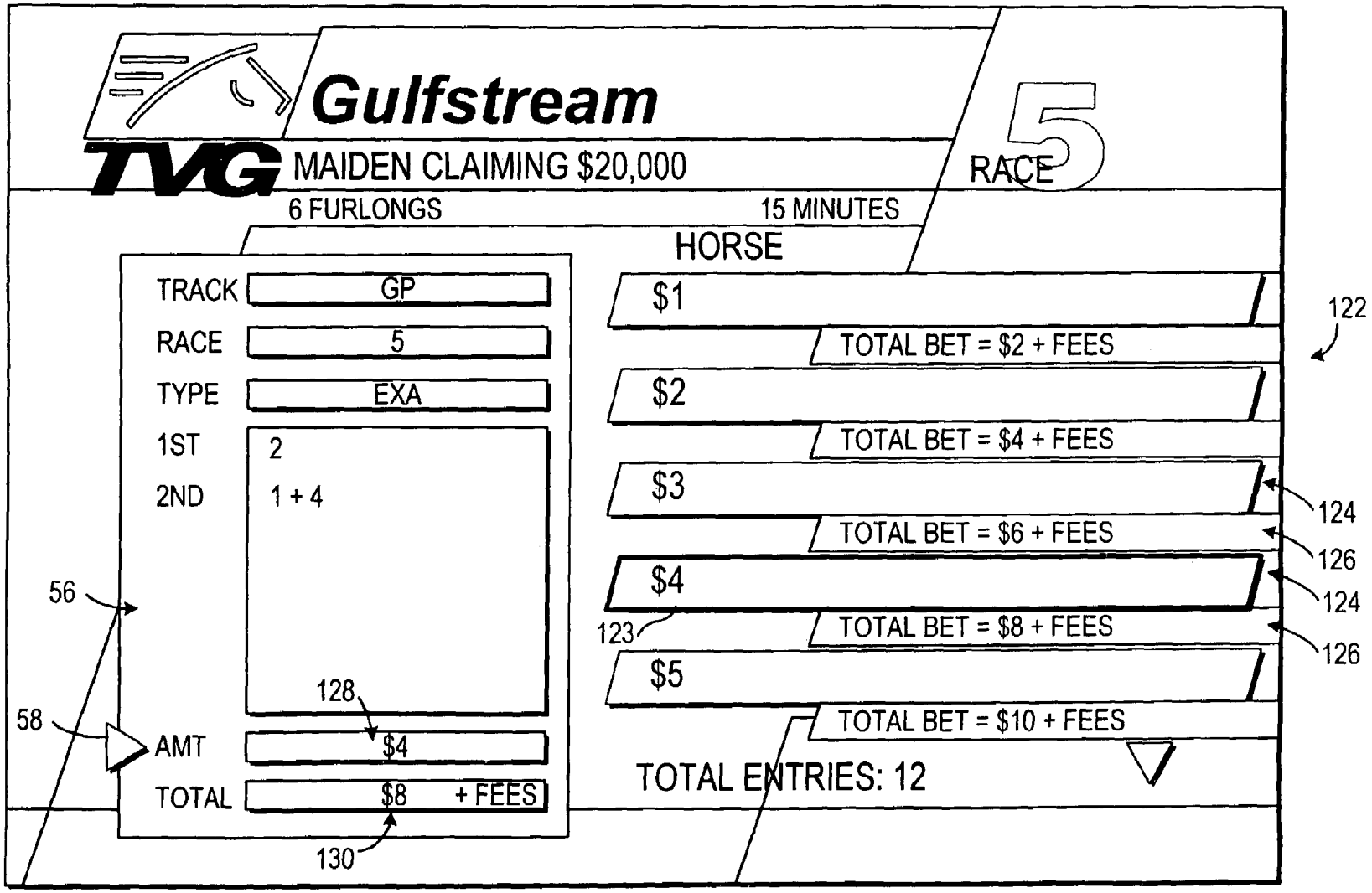
FIG. 11 shows an illustrative wager amount selection screen that may be provided by the interactive wagering application in accordance with the present invention.

As shown in FIG. 11, screen 122 may provide the user with an opportunity to select from various wager amounts. A highlight region 123 may be used to highlight a desired wager amount option. There are a number of wager amount fields 124, each containing a different wager amount. There is a corresponding information area 126 for each wager amount field 124. The interactive wagering application may display any suitable information in information areas 126. In the example of FIG. 11, each information area 126 contains the results of a calculation indicating how much the user's total wager would amount to after taking into account any multiple runner selection that the user has made. In particular, because the user has chosen an extra runner for the second place finisher in the exacta wager of FIG. 11, this amounts to two exacta wagers (one for horse 2 to win and horse 1 to place and one for horse 2 to win and horse 4 to place). Because two wagers are being made, each information area 126 shows that the wager amount chosen will be half of the user's total wager amount. As an example, if the user selects a $4 wager amount by highlighting the wager amount field for $4 wagers as shown in FIG. 11, the total amount deducted from the user's account for the wager (not accounting for any possible winnings) will be $8. This is also reflected in wagering ticket 56, in which the wager amount 128 ($4) and the total amount being wagered 130 ($8) are shown separately. The position of indicator 58 may be updated to reflect that the user is selecting a wager amount.

Figure 12:
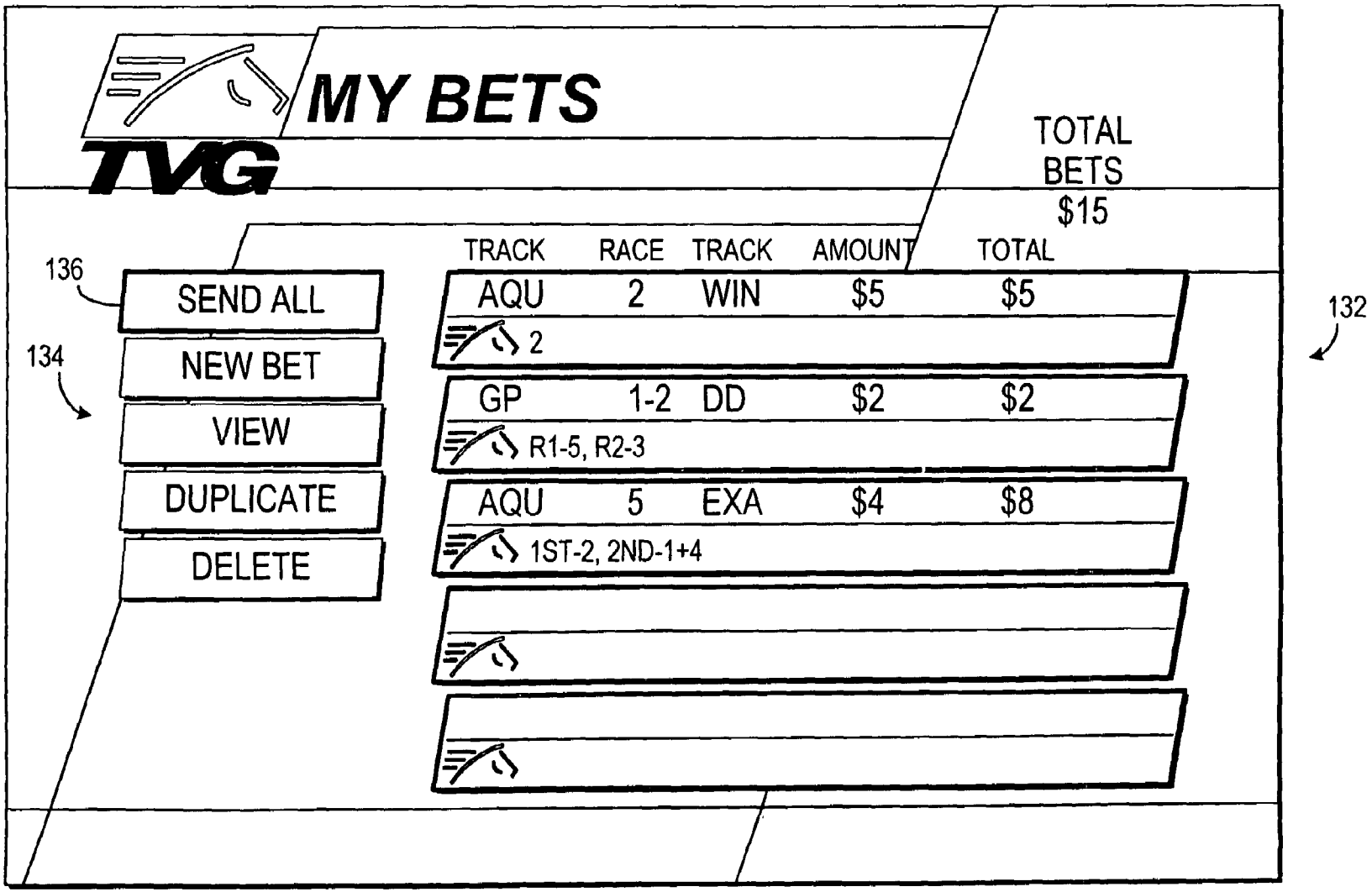
FIG. 12 shows an illustrative wager list screen that may be provided by the interactive wagering application in accordance with the present invention.

When the user has finished selecting a wager amount, the interactive wagering application may display a screen such as screen 132 of FIG. 12. Screen 132 may list all of the wagers that the user has created but not placed. Options 134 may be provided to allow the user to create a new wager, view wager details, duplicate a wager, and delete a wager. Options 134 also include an option to send all created wagers. In the example of FIG. 12, the user has used highlight region 136 to highlight the send all option. When the user selects the send all option, the wagers listed in screen 132 are submitted to transaction processing and subscription management system 24 for processing.

Figure 13:
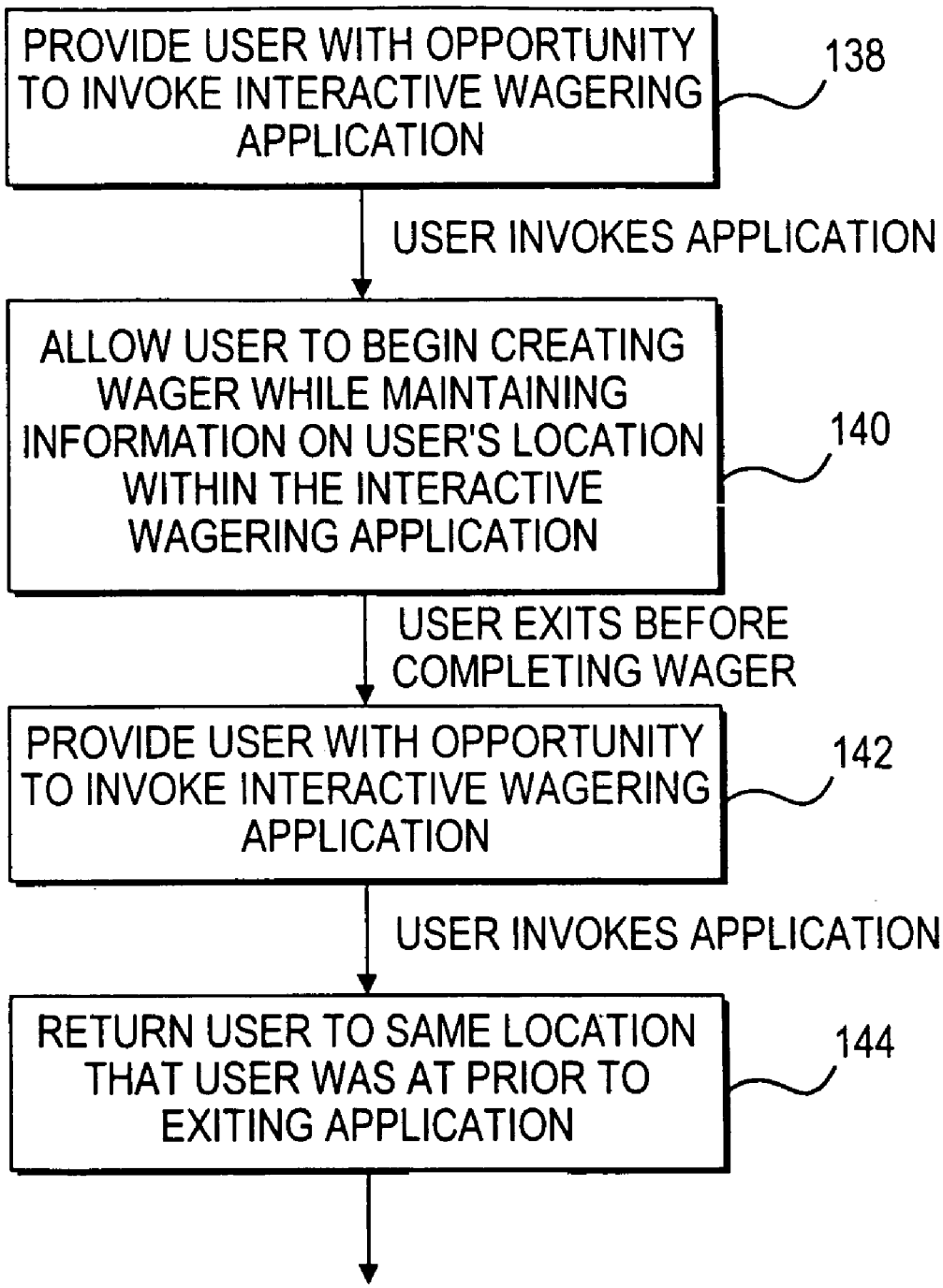
FIG. 13 is a flow chart of illustrative steps involved in using an interactive wagering application that retains information about the user's last position in the application when the user exits the application in accordance with the present invention.

A flow chart of illustrative steps involved in using an interactive wagering application that retains information about the user's last position in the application when the user exits the application is shown in FIG. 13. At step 138, the user may be provided with an opportunity to invoke the interactive wagering application.

At step 140, after the user has invoked the application, the interactive wagering application may allow the user to create a wager. While the user is creating the wager (e.g., by selecting a track, race, etc.), the interactive wagering application maintains a record of the user's position in the application (e.g., which screen the user is on). The record of the user's position may be stored locally (e.g., in user television equipment 22, user computer equipment 20, or user telephone equipment 32) or may be stored remotely (e.g., on a server at television distribution facility 18, on computer equipment 26 at transaction processing and subscription management system 24, or any other suitable storage location).

The user may exit the interactive wagering application before completing the wager.

At step 142, after the user has exited the application, the user may be provided with another opportunity to invoke the interactive wagering application.

At step 144, after the user has invoked the interactive wagering application, the user may be returned to the same location within the interactive wagering application at which the user was located prior to exiting the application. The interactive wagering application may return the user to the same location by consulting the information in the stored record of the user's last position.

Figure 14:
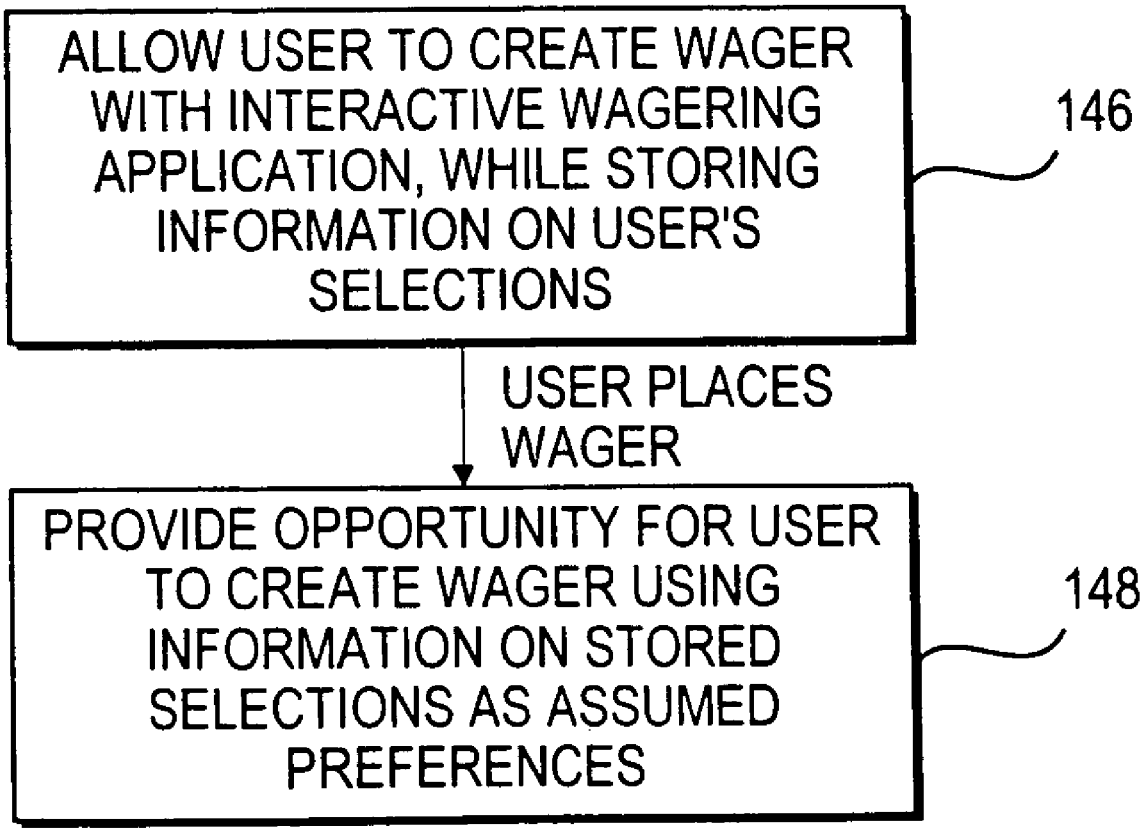
FIG. 14 is a flow chart of illustrative steps involved in creating a wager with an interactive wagering application that retains information about a user's recent selections in accordance with the present invention.

If desired, the interactive wagering application may store information on the user's last wager and use this information as assumed preferences when the user creates a subsequent wager. Illustrative steps involved in creating a wager with an interactive wagering application that retains information about a user's recent selections are shown in FIG. 14. At step 146, after the user has invoked the application, the interactive wagering application may allow the user to create a wager. While the user is creating the wager (e.g., by selecting a track, race, etc.), the interactive wagering application maintains a record of which selections were made by the user. The selections made by the user are indicative of the user's wagering preferences. The record of the user's selections may be stored locally (e.g., in user television equipment 22, user computer equipment 20, or user telephone equipment 32) or may be stored remotely (e.g., on a server at television distribution facility 18, on computer equipment 26 at transaction processing and subscription management system 24, or any other suitable storage location).

After the user has placed a wager, the user may exit the application and restart the application or may continue to create wagers with the application without exiting. In either event, the user may be provided with an opportunity to create a wager using the stored record of the user's wager selections at step 148. For example, the user's most frequently chosen wager criteria or selections or the user's last wager may be used to assist the user when creating the new wager. When the user is creating the new wager, the interactive wagering application may assume that the wagering criteria (e.g., the selected track, race, wager type, horses, and wager amount) that were last used or were most frequently used reflect the user's preferences. Accordingly, these wagering criteria may be used as defaults when the interactive wagering application is populating fields in the wager creation screens. As an example, if the user's last wager was made at the track Churchill Downs, the next time that the interactive wagering application presents the track selection menu to the user, the track Churchill Downs may be preselected in the track selection menu. The user therefore need not search for the Churchill Downs entry when selecting the track for the wager.

If desired, personnel at a track or any other suitable party (e.g., the provider of the interactive wagering service) may configure the information areas shown in FIGS. 3–11. For example, personnel associated with a racetrack may change the information area associated with their track to inform wagerers that the track is closed due to inclement weather or that there is a special at the track. These changes may be made without recompiling the code for the interactive wagering application.

Figure 15:
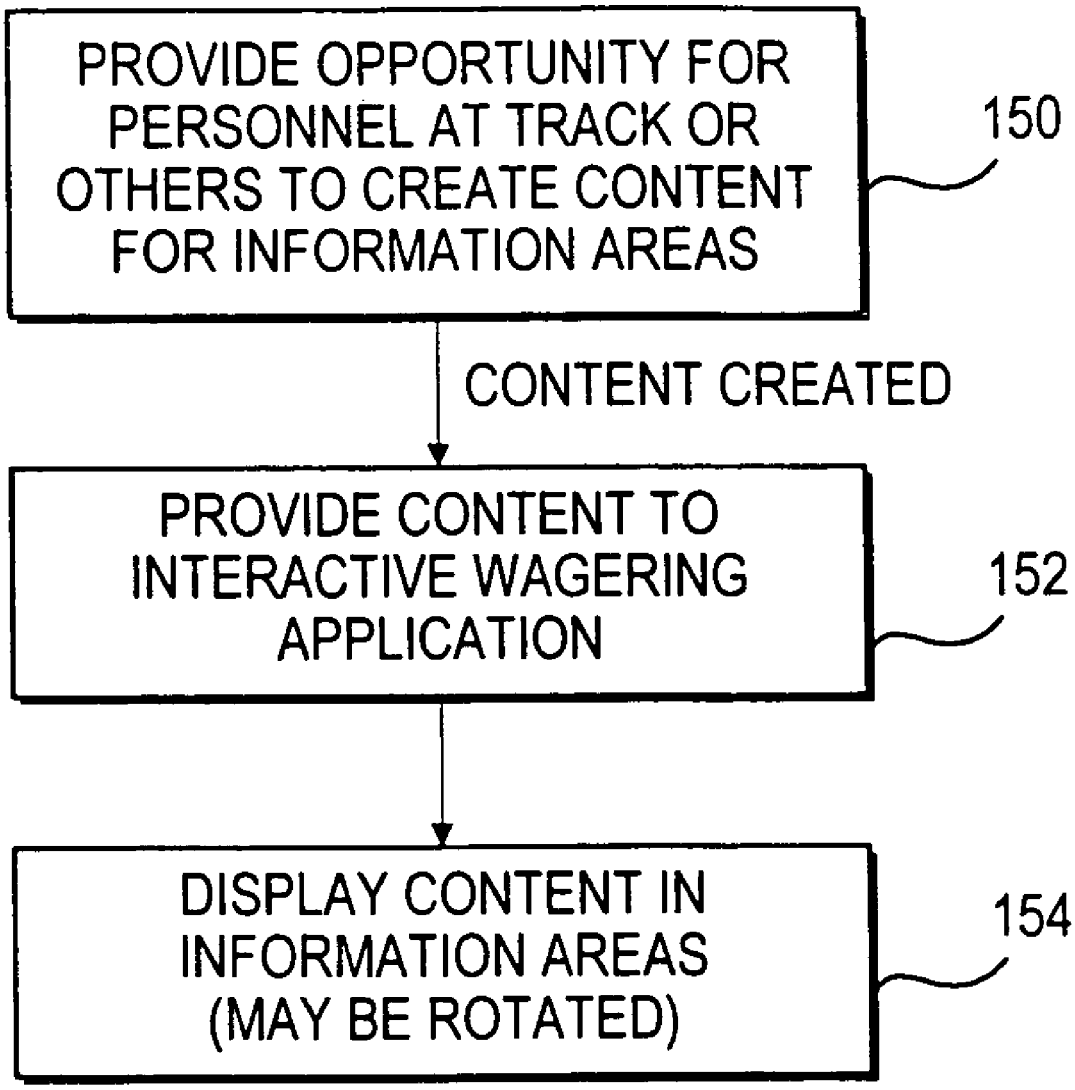
FIG. 15 is a flow chart of illustrative steps involved in using an interactive wagering application that provides information areas with customizable content in accordance with the present invention.

Illustrative steps involved in using an interactive wagering application that provides information areas with customizable content are shown in FIG. 15. At step 150, personnel at a racetrack or any other suitable party (e.g., the operator of the interactive wagering application located at, for example, transaction processing and subscription management system 24), may be provided with an opportunity to create content for the information areas. For example, a web site or other user interface may be provided that allows the appropriate party to enter in the desired content for the information area.

Once the content has been created, the content may be provided to the interactive wagering application at step 152. For example, the information may be transmitted from the web site to computing equipment 26 over the communications paths of FIG. 1.

At step 154, the content that has been created may be displayed in information areas of the type generally illustrated in FIGS. 2–11.

If desired, the features of the present invention may be used with other types of racing, such as dog or harness racing (a type of horse racing).

The foregoing is merely illustrative of the principles of this invention and various modifications can be made by those skilled in the art without departing from the scope and spirit of the invention.

What is claimed is:

1. A method for allowing users to place electronic wagers on races that are to be run using an interactive wagering application that is implemented using user equipment having a display, comprising:

displaying a wager creation screen for a user on the display, wherein the wager creation screen includes a plurality of interactive menu items that consists of all menu items that are selections for a wager requirement provided in the wager creation screen, wherein each menu item has a distinct associated information area that is provided on the wager creation screen, wherein each associated information includes information related to the associated menu item, wherein at least one of the information areas is interactive, and wherein the user creates a wager by selecting desired menu items on the wager creation screen; and providing the user with an opportunity to use the interactive wagering application to place the wager.

2. The method defined in claim 1, further comprising displaying, in response to a user selection of an interactive information area, a screen containing additional information related to the content of the selected interactive information area.

3. The method defined in claim 1, wherein at least one of the wager creation screens is a racetrack selection screen in which the menu items are selectable racetrack options.

4. The method defined in claim 1, wherein at least one of the wager creation screens is a race selection screen in which the menu items are selectable race options.

5. The method defined in claim 1, wherein at least one of the wager creation screens is a horse selection screen in which the menu items are selectable horse options.

6. The method defined in claim 1, wherein at least one of the wager creation screens is a wager type selection screen in which the menu items are selectable wager type options.

7. The method defined in claim 1, wherein at least one of the wager creation screens is a wager amount selection screen in which the menu items are selectable wager amount options.

8. The method defined in claim 1, wherein the user selects multiple runners for a given wager with the wager creation screens, wherein at least one of the wager creation screens is a wager amount selection screen in which the menu items are selectable wager amount options and wherein the information areas that are associated with the wager amount options are located adjacent to the wager amount options and contain information indicating how much the given wager costs for each wager amount option taking into account the multiple runners that have been selected.

9. The method defined in claim 1, further comprising allowing a content creator to modify the content in the information areas.

10. The method defined in claim 1, further comprising automatically rotating the content displayed in the information areas.

11. An interactive wagering system that provides a user with an opportunity to submit electronic wagers on races that are to be run to computer equipment over a communications path using an interactive wagering application, comprising:

user equipment with which the interactive wagering application is implemented, wherein the user equipment is configured to:

display a wager creation screen for a user on the display, wherein the wager creation screen includes a plurality of interactive menu items that consists of all menu items that are selections for a wager requirement provided in the wager creation screen, wherein each menu item has a distinct associated information area that is provided on the wager creation screen, wherein each associated information area includes information related to the associated menu item, wherein at least one of the information areas is interactive, and wherein the user creates a wager by selecting desired menu items on the wager creation screen; and provide the user with an opportunity to use the interactive wagering application to place the wager.

12. The system defined in claim 11, wherein the user equipment is further configured to display, in response to a user selection of an interactive information area, a screen containing additional information related to the content of the selected interactive information area.

13. The system defined in claim 11, wherein at least one of the wager creation screens is a racetrack selection screen in which the menu items are selectable racetrack options.

14. The system defined in claim 11, wherein at least one of the wager creation screens is a race selection screen in which the menu items are selectable race options.

15. The system defined in claim 11, wherein at least one of the wager creation screens is a horse selection screen in which the menu items are selectable horse options.

16. The system defined in claim 11, wherein at least one of the wager creation screens is a wager type selection screen in which the menu items are selectable wager type options.

17. The system defined in claim 11, wherein at least one of the wager creation screens is a wager amount selection screen in which the menu items are selectable wager amount options.

18. The system defined in claim 11, wherein the user selects multiple runners for a given wager with the wager creation screens, wherein at least one of the wager creation screens is a wager amount selection screen in which the menu items are selectable wager amount options and wherein the information areas that are associated with the wager amount options are located adjacent to the wager amount options and contain information indicating how much the given wager costs for each wager amount option taking into account the multiple runners that have been selected.

19. The system defined in claim 11 wherein the user equipment is further configured to allow a content creator to modify the content in the information areas.

20. The system defined in claim 11 wherein the user equipment is further configured to automatically rotate the content displayed in the information areas.

21. An interactive wagering system that provides a user with an opportunity to submit electronic wagers on races that are to be run to computer equipment over a communications path using an interactive wagering application, comprising:

means for displaying a wager creation screen for a user on the display, wherein the wager creation screen includes a plurality of interactive menu items that consists of all menu items that are selections for a wager requirement provided in the wager creation screen, wherein each menu item has a distinct associated information area that is provided on the wager creation screen, wherein each associated information includes information related to the associated menu item, wherein at least one of the information areas is interactive, and wherein the user creates a wager by selecting desired menu items on the wager creation screen; and means for providing the user with an opportunity to use the interactive wagering application to place the wager.

22. The system defined in claim 21, further comprising means for displaying, in response to a user selection of an interactive information area, a screen containing additional information related to the content of the selected interactive information area.

23. The system defined in claim 21, wherein at least one of the wager creation screens is a racetrack selection screen in which the menu items are selectable racetrack options.

24. The system defined in claim 21, wherein at least one of the wager creation screens is a race selection screen in which the menu items are selectable race options.

25. The system defined in claim 21, wherein at least one of the wager creation screens is a horse selection screen in which the menu items are selectable horse options.

26. The system defined in claim 21, wherein at least one of the wager creation screens is a wager type selection screen in which the menu items are selectable wager type options.

27. The system defined in claim 21, wherein at least one of the wager creation screens is a wager amount selection screen in which the menu items are selectable wager amount options.

28. The system defined in claim 21, wherein the user selects multiple runners for a given wager with the wager creation screens, wherein at least one of the wager creation screens is a wager amount selection screen in which the menu items are selectable wager amount options and wherein the information areas that are associated with the wager amount options are located adjacent to the wager amount options and contain information indicating how much the given wager costs for each wager amount option taking into account the multiple runners that have been selected.

29. The system defined in claim 21, further comprising means for allowing a content creator to modify the content in the information areas.

30. The system defined in claim 21, further comprising means for automatically rotating the content displayed in the information areas.

31. A machine-readable medium for allowing users to place electronic wagers on races that are to be run using an interactive wagering application that is implemented using user equipment having a display, comprising machine program logic recorded thereon for:

displaying a wager creation screen for a user on the display, wherein the wager creation screen includes a plurality of interactive menu items that consists of all menu items that are selections for a wager requirement provided in the wager creation screen, wherein each menu item has a distinct associated information area that is provided on the wager creation screen, wherein each associated information includes information related to the associated menu item, wherein at least one of the information areas is interactive, and wherein the user creates a wager by selecting desired menu items on the wager creation screen; and providing the user with an opportunity to use the interactive wagering application to place the wager.

32. The machine-readable medium defined in claim 31, further comprising machine program logic recorded thereon for displaying, in response to a user selection of an interactive information area, a screen containing additional information related to the content of the selected interactive information area.

33. The machine-readable medium defined in claim 31, wherein at least one of the wager creation screens is a racetrack selection screen in which the menu items are selectable racetrack options.

34. The machine-readable medium defined in claim 31, wherein at least one of the wager creation screens is a race selection screen in which the menu items are selectable race options.

35. The machine-readable medium defined in claim 31, wherein at least one of the wager creation screens is a horse selection screen in which the menu items are selectable horse options.

36. The machine-readable medium defined in claim 31, wherein at least one of the wager creation screens is a wager type selection screen in which the menu items are selectable wager type options.

37. The machine-readable medium defined in claim 31, wherein at least one of the wager creation screens is a wager amount selection screen in which the menu items are selectable wager amount options.

38. The machine-readable medium defined in claim 31, wherein the user selects multiple runners for a given wager with the wager creation screens, wherein at least one of the wager creation screens is a wager amount selection screen in which the menu items are selectable wager amount options and wherein the information areas that are associated with the wager amount options are located adjacent to the wager amount options and contain information indicating how much the given wager costs for each wager amount option taking into account the multiple runners that have been selected.

39. The machine-readable medium defined in claim 31, further comprising machine program logic recorded thereon for allowing a content creator to modify the content in the information areas.

40. The machine-readable medium defined in claim 31, further comprising machine program logic recorded thereon for automatically rotating the content displayed in the information areas.

* * * * *

UNITED STATES PATENT AND TRADEMARK OFFICE

CERTIFICATE OF CORRECTION

PATENT NO. : 7,201,658 B2
APPLICATION NO. : 10/881349
DATED : April 10, 2007
INVENTOR(S) : Marshall et al.

It is certified that error appears in the above-identified patent and that said Letters Patent is hereby corrected as shown below:

Page 2, Item (56), under the title "References Cited", second column,
after "5,816,919 10/1998 Scagnelli et al.", insert
-- 5,823,877 10/1998 Scagnelli et al. --;
in "6,837,791" change "Ramsey et al." to -- McNutt et al. --.
Column 6, line 38, delete second occurrence of "such as".
Column 9, line 63, change "be" to -- by --.
Column 14, line 1, after "wagering" delete ".".
Column 15, lines 66-67, after "a claiming race," delete "a maiden claiming race,".

Signed and Sealed this

Twenty-fourth Day of June, 2008

JON W. DUDAS
*Director of the United States Patent and Trademark Office*